US007794650B2

(12) United States Patent
Igarashi et al.

(10) Patent No.: US 7,794,650 B2
(45) Date of Patent: Sep. 14, 2010

(54) HEAT-RESISTANT CAST IRON AND EXHAUST EQUIPMENT MEMBER FORMED THEREBY

(75) Inventors: Yoshio Igarashi, Tochigi-ken (JP); Seiichi Endo, Tochigi-ken (JP); Masahiro Miyake, Tochigi-ken (JP); Tsunehiro Kawata, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 482 days.

(21) Appl. No.: 10/591,756

(22) PCT Filed: Nov. 9, 2004

(86) PCT No.: PCT/JP2004/016610

§ 371 (c)(1),
(2), (4) Date: Sep. 1, 2006

(87) PCT Pub. No.: WO2005/085488

PCT Pub. Date: Sep. 15, 2005

(65) Prior Publication Data

US 2008/0308193 A1 Dec. 18, 2008

(30) Foreign Application Priority Data

Mar. 4, 2004 (JP) ..... 2004-060440

(51) Int. Cl.
*C22C 37/00* (2006.01)
*C22C 37/04* (2006.01)

(52) U.S. Cl. ..... 420/9; 420/10; 420/13; 148/321; 148/324

(58) Field of Classification Search ..... 148/321–324; 420/9–33

See application file for complete search history.

(56) References Cited

U.S. PATENT DOCUMENTS

| | | | |
|---|---|---|---|
| 4,435,226 | A | 3/1984 | Neuhäuser et al. |
| 5,194,220 | A | 3/1993 | Takahashi et al. |

FOREIGN PATENT DOCUMENTS

| | | | |
|---|---|---|---|
| DE | 2428821 | * | 12/1975 |
| EP | 0 430 241 | A1 | 6/1991 |
| EP | 0 471 255 | A1 | 2/1992 |
| JP | 55-134153 | | 10/1980 |
| JP | 55-134153 | A | 10/1980 |
| JP | 58-104154 | A | 6/1983 |
| JP | 61-157655 | | 7/1986 |
| JP | 61-157655 | A | 7/1986 |

(Continued)

*Primary Examiner*—Deborah Yee
(74) *Attorney, Agent, or Firm*—Sughrue Mion, PLLC

(57) ABSTRACT

A graphite-containing, heat-resistant cast iron for exhaust equipment members used at temperatures exceeding 800° C., comprising 3.5-5.6% of Si and 1.2-15% of W on a weight basis, and having intermediate layers, in which W and Si are concentrated, in the boundaries of graphite particles and a matrix. An exhaust equipment member formed by this heat-resistant cast iron has an $A_{C1}$ transformation point is 840° C. or higher when measured from 30° C. at a temperature-elevating speed of 3° C./minute, and a thermal cracking life of 780 cycles or more in a thermal fatigue test, in which heating and cooling are conducted under the conditions of an upper-limit temperature of 840° C., a temperature amplitude of 690° C. and a constraint ratio of 0.25.

18 Claims, 12 Drawing Sheets

FOREIGN PATENT DOCUMENTS

| | | | |
|---|---|---|---|
| JP | 09-087796 | | 3/1997 |
| JP | 10-195587 | | 7/1998 |
| JP | 11-071628 | | 3/1999 |
| JP | 2000-063976 | A | 2/2000 |
| JP | 2001-181780 | A | 3/2001 |
| JP | 2002-339033 | | 11/2002 |
| RU | 2012653 | * | 5/1994 |

* cited by examiner

HEAT-RESISTANT CAST IRON AND EXHAUST EQUIPMENT MEMBER FORMED THEREBY

FIELD OF THE INVENTION

The present invention relates to a heat-resistant cast iron having high oxidation resistance and thermal crack resistance, particularly to a heat-resistant cast iron suitable for exhaust equipment members for automobile engines, such as exhaust manifolds, turbocharger housings, catalyst cases, etc.

BACKGROUND OF THE INVENTION

Exhaust equipment members for automobile engines, such as exhaust manifolds, turbocharger housings, catalyst cases, exhaust manifolds integral with turbocharger housings, exhaust manifolds integral with catalyst cases, exhaust outlets, etc. are required to have improved heat resistance such as oxidation resistance and thermal crack resistance as well as high durability and long life, because they are used in such severe conditions as repeatedly exposed to high-temperature exhaust gases from engines with direct exposure to sulfur oxides, nitrogen oxides, etc. in the exhaust gas. The exhaust equipment members have conventionally been formed by inexpensive, high-Si, ferritic spheroidal graphite cast iron containing about 4% by weight of Si, which has relatively good heat resistance as well as good castability and machinability among the cast irons.

Because of recent improvement of the performance and fuel efficiency of automobile engines, and tightened regulations of exhaust gas emission, the exhaust gases tend to have higher temperatures. Accordingly, exhaust equipment members sometimes become higher than 800° C., so that higher heat resistance such as oxidation resistance, thermal crack resistance, etc. is required for the exhaust equipment members. Various improvements of the high-temperature properties of spheroidal graphite cast irons have thus been investigated.

Although conventional high-Si, ferritic spheroidal graphite cast irons have excellent castability and machinability at low production costs, their heat resistance such as oxidation resistance and thermal crack resistance is limited, so that exhaust equipment members made thereof cannot be used at temperatures exceeding 800° C.

JP9-87796A discloses a heat-resistant spheroidal graphite cast iron having a composition comprising, on a weight basis, 2.7-3.2% of C, 4.4-5.0% of Si, 0.6% or less of Mn, 0.5-1.0% of Cr, 0.1-1.0% of Ni, 1.0% or less of Mo, and 0.1% or less of a spheroidizing agent, the balance being substantially Fe, and a matrix based on a ferrite phase. This heat-resistant spheroidal graphite cast iron exhibits high oxidation resistance and thermal crack resistance in an environment subjected to repeated thermal load between 150° C. and 800° C., because of a relatively large amount of Si and small amounts of Cr and Ni added, so that it is suitable for exhaust equipment members for automobile engines, such as turbocharger housings, exhaust manifolds, etc. However, because this heat-resistant spheroidal graphite cast iron does not contain W, it is not necessarily sufficient in oxidation resistance and thermal crack resistance, failing to exhibit a satisfactory thermal cracking life particularly when used for exhaust equipment members repeatedly subjected to heating and cooling from room temperature to temperatures exceeding 800° C.

JP2002-339033A discloses a ferritic spheroidal graphite cast iron with improved high-temperature properties, which has a composition comprising, on a weight basis, 3.1-4.0% of C, 3.6-4.6% of Si, 0.3-1.0% of Mo, 0.1-1.0% of V, 0.15-1.6% of Mn, and 0.02-0.10% of Mg, the balance being Fe and inevitable impurities. The addition of V and Mn to a Si- and Mo-based composition improves not only high-temperature strength, thermal deformation resistance and thermal fatigue resistance, but also tensile strength and yield strength from room temperature to a high-temperature region of about 800-900° C., thereby increasing a life until initial cracking occurs, and improving thermal fatigue resistance. This is because V provides high-melting-point, fine carbide particles precipitated substantially in eutectic cell grain boundaries, thereby increasing grain boundary potential and preventing the pearlite structure from being decomposed at high temperatures, and because Mn accelerates the precipitation of the pearlite structure, thereby improving tensile strength and yield strength. However, because this ferritic spheroidal graphite cast iron does not contain W, it is not necessarily sufficient in oxidation resistance and thermal crack resistance.

JP10-195587A discloses a spheroidal graphite cast iron having a composition comprising, on a weight basis, 2.7%-4.2% of C, 3.5%-5.2% of Si, 1.0% or less of Mn, 0.03% or less of S, 0.02-0.15% of at least one of Mg, Ca and rare earth elements (including at least 0.02% of Mg), and 0.03-0.20% of As, the balance being Fe and inevitable impurities, with brittleness suppressed at middle temperatures around 400° C. This spheroidal graphite cast iron has improved high-temperature strength because it further contains 1% or less by weight of at least one of Cr, Mo, W, Ti and V as a matrix-strengthening component, and it also has improved ductility because of carbide suppressed by containing 3% or less by weight of Ni or Cu, a graphitizing element. Although the mechanism of suppressing embrittlement at middle temperatures is not necessarily clear, Mg remaining after the spheroidization, which is expected to segregate to crystal grain boundaries to cause embrittlement at middle temperatures, is combined with As to prevent the embrittlement function of Mg, and As remaining after combination with Mg improves the bonding of crystal grains, thereby mitigating or suppressing brittleness at middle temperatures.

However, because the amounts of Cr. Mo, W, Ti and V are as small as 1% or less by weight in this spheroidal graphite cast iron, it is not necessarily sufficient in oxidation resistance and thermal crack resistance when used for exhaust equipment members repeatedly heated and cooled. Also, the inclusion of As deteriorates the oxidation resistance of the spheroidal graphite cast iron at 700° C. or higher. In addition, As is toxic and extremely harmful to humans and the environment even in a trace amount, necessitating a facility for preventing operators from being intoxicated from the melting step to the casting step, and needing intoxication-preventing measures in the repair and maintenance of the apparatus. Further, it poses environmental pollution problems in the recycling of products. Thus, the As-containing, spheroidal graphite cast iron is not practically usable.

The conventional high-Si, ferritic spheroidal graphite cast iron has as low a ferrite-austenite transformation temperature ($A_{C1}$ transformation point) as about 800° C., at which the matrix structure changes from a ferrite/pearlite phase to an austenite phase. The austenite has a larger linear expansion coefficient than that of the ferrite. Accordingly, when part of an exhaust equipment member becomes about 800° C. or higher, higher than the $A_{C1}$ transformation point, the matrix changes to an austenite phase and so drastically expands, resulting in strain due to the expansion ratio difference. Also, when the temperature of the exhaust equipment member is lowered by engine stop, etc., the exhaust equipment member passes through the austenite-ferrite transformation temperature ($A_{r1}$ transformation point), resulting in strain due to the expansion ratio difference. Thus, the exhaust equipment member formed by the high-Si, ferritic spheroidal graphite cast iron is largely deformed by expansion and contraction due to the phase transformation in a state where it is constrained by other members by bolt fastening, etc. Also, repeated passing of the $A_{C1}$ transformation point and the $A_{r1}$ transformation point causes the precipitation of secondary graphite, resulting in irreversible expansion and thus large deformation.

In addition, the exhaust equipment member is exposed to high-temperature exhaust gases containing sulfur oxides, nitrogen oxides, etc. and oxygen in the air at high temperatures, etc. (hereinafter referred to as "oxidizing gases"), resulting in oxide layers formed on the surface. When the oxide layers are heated to temperatures near the $A_{C1}$ transformation point or higher and cooled, deformation and internal strain are generated by the difference in thermal expansion between the oxide layers and the matrix, resulting in microcracks in the oxide layers. The oxidizing gases penetrating through the cracks oxidize the inside of the exhaust equipment member (internal oxidation), so that cracks further propagate. The oxidation and cracking of the exhaust equipment member at high temperatures are thus closely related, both having large influence on the heat resistance, durability, life, etc. of the exhaust equipment member. Although the high-Si, ferritic spheroidal graphite cast iron containing about 4% of Si has a higher $A_{C1}$ transformation point and thus higher oxidation resistance than those of usual spheroidal graphite cast irons, it exhibits insufficient oxidation resistance and thermal crack resistance when heated to 800° C. (the $A_{C1}$ transformation point) or higher, resulting in a short life.

Accordingly, presently used for exhaust equipment members operable at temperatures exceeding about 800° C. in place of the conventional high-Si, ferritic spheroidal graphite cast iron having limited heat resistance such as oxidation resistance, thermal crack resistance, etc., are austenitic spheroidal graphite cast iron such as FCDA-NiCr20 2 (NI-RESIST D2), FCDA-NiSiCr35 5 2 (NI-RESIST D5S) containing about 18-35% by weight of Ni, etc., ferritic cast stainless steel containing 18% or more by weight of Cr, and austenitic cast stainless steel containing 18% or more by weight of Cr and 8% or more by weight of Ni, which have higher heat resistance than that of the conventional high-Si, ferritic spheroidal graphite cast iron.

However, the austenitic spheroidal graphite cast iron and the cast stainless steel are expensive because they contain expensive Ni or Cr. Also, because the austenitic spheroidal graphite cast iron and the cast stainless steel have high melting points, they have low melt fluidity and poor castability, so that they are likely to suffer casting defects such as shrinkage cavities, misrun, etc., and low casting yields. Accordingly, to produce exhaust equipment members at high yields, high casting techniques and special production facilities are needed. In addition, because they have poor machinability due to coarse carbides of Cr, etc., added in large amounts, high machining techniques are needed. With such problems, exhaust equipment members formed by the austenitic spheroidal graphite cast iron or the cast stainless steel are inevitably extremely expensive.

The internal oxidation of gray cast iron (flake graphite cast iron) in a high-temperature, oxidizing atmosphere appears to occur by the decarburization of graphite and the formation of oxides in the matrix by oxidizing gases intruding along three-dimensionally connected flaky graphite, resultant gaps and cracks accelerating the intrusion of oxidizing gases. To suppress the internal oxidation, the following proposals have been made.

(1) Flaky graphite having continuity is spheroidized, made finer, and reduced in their area ratio, to isolate graphite particles from each other, thereby suppressing the intrusion of oxidizing gases.

(2) 4-5% of Si is added to turn the matrix structure to silicoferrite, thereby elevating the $A_{C1}$ transformation point.

(3) Carbide-stabilizing elements such as Cr, Mn, Mo, V, etc. are added to solid-solution-strengthen the matrix, thereby stabilizing pearlite and cementite.

However, any flake graphite cast irons and spheroidal graphite cast irons obtained by making graphite particles spheroidal, which are proposed above, fail to satisfactorily suppress the internal oxidation and heat cracking of exhaust equipment members used in environments at about 800° C. or higher.

The spheroidal graphite cast irons per se are long-known materials, and those having various compositions to be used for other applications than the exhaust equipment members have been proposed. For instance, JP61-157655A discloses a cast alloy iron tool comprising 3.0-7.0% of C, 5.0% or less of Si, 3.0% or less of Mn, 0.5-40.0% of Ni, 0.5-20.0% of Cr, and one or more of 0.5-30.0% of Cu, 0.1-30.0% of Co, 0.1-10.0% of Mo, 0.1-10.0% of W, 0.05-5.0% of V, 0.01-3.0% of Nb, 0.01-3.0% of Zr and 0.01-3.0% of Ti, the balance being substantially Fe, having a graphite area ratio of 5.0% or more, and a precipitated carbide or carbonitride area ratio of 1.0% or more. The wear resistance of this cast alloy iron is mainly provided by hard Cr carbide or carbonitride particles crystallized during casting. However, because the Cr carbide lowers toughness and ductility, this cast alloy iron does not have toughness and ductility necessary for the exhaust equipment members. In addition, because hard carbide or carbonitride particles lower the machinability, the cast alloy iron has low machining efficiency, resulting in increased production costs and thus expensive exhaust equipment members. Further, because it contains as much Ni as 0.5-40.0%, the ferrite-based cast iron (ferritic cast iron) has low $A_{C1}$ transformation point and oxidation resistance, failing to achieve sufficient durability and life when used in environments higher than 800° C. Accordingly, heat-resistant cast irons suitable for exhaust equipment members used in environments higher than 800° C. cannot be conceived of from the cast tool described in JP61-157655A.

JP11-71628A discloses a composite roll with excellent thermal shock resistance comprising an outer ring made of tungsten carbide-based cemented carbide, and an inner ring made of spheroidal graphite cast iron and bonded to the outer ring by casting, the inner ring having a composition comprising, on a weight basis, 3-4.5% of C, 1.5-4.5% of Si, 0.1-2% of Mn, 0.02-0.2% of Mg, and 0.1-5% of one or more of Mo, Cu, Cr, V, W, Sn and Sb, the balance being Fe and inevitable impurities, and a structure having core-structure spheroidal graphite particles dispersed in a matrix based on a mixed phase of a ferrite phase and any one of a pearlite phase, a bainite phase and a martensite phase, and each core-structure spheroidal graphite particle comprising a core formed during the casting, and a shell precipitated during the heat treatment. To obtain the mixed phase of this spheroidal graphite cast iron, an as-cast pearlite phase-based matrix is first formed, a heat treatment comprising repeated heating and cooling in a temperature range between 450° C. and a solid phase line is conducted to form the ferrite phase, and the matrix is then turned to the mixed phase based on the pearlite phase and the ferrite phase.

However, when the spheroidal graphite cast iron of JP 11-71628A is used for exhaust equipment members operable in environments higher than 800° C., the pearlite phase, the bainite phase and the martensite phase are decomposed to precipitate secondary graphite, failing to exhibit enough durability by irreversible expansion. Among Mo, Cu, Cr, V, W, Sn and Sb, V deteriorates the oxidation resistance at temperatures exceeding 800° C., and Sn and Sb form abnormal flaky graphite in eutectic cell boundaries and cementite in the matrix when used in excess amounts, resulting in decrease in toughness and ductility, particularly decrease in room-temperature elongation. Accordingly, unless the alloying elements and their amounts are properly selected from Mo, Cu, Cr, V, W, Sn and Sb, it would not exhibit sufficient $A_{C1}$ transformation point, oxidation resistance, thermal crack resistance, toughness and ductility as a material for exhaust equipment members used in environments higher than 800° C. Accordingly, heat-resistant cast irons suitable for exhaust equipment members used in environments higher than 800° C. cannot be conceived of from the composite roll described in JP 11-71628A.

OBJECTS OF THE INVENTION

Accordingly, an object of the present invention is to provide heat-resistant cast iron having excellent oxidation resistance and thermal crack resistance, from which, for instance, highly heat-resistant exhaust equipment members for automobile engines can be produced at low costs.

DISCLOSURE OF THE INVENTION

Cast iron parts needing high heat resistance should have high oxidation resistance and thermal crack resistance as well as good room-temperature elongation and high-temperature strength. Among them, the oxidation resistance is an important property that largely affects thermal crack resistance having close relation to oxidation at high temperatures.

To improve the oxidation resistance and thermal crack resistance of cast iron, it is necessary to suppress the oxidation of graphite particles and their surrounding matrix regions, which tends to cause internal oxidation and cracking. However, such oxidation cannot necessarily be suppressed fully only by improvement in the shape and distribution of graphite particles as proposed above to suppress the internal oxidation of flake graphite cast iron. This is because when oxidizing gases intrude into the cast iron along the graphite particles, oxidation occurs in the graphite particles and their surrounding matrix regions. As a result intense research, the inventors have found that to prevent graphite particles and their surrounding matrix regions from being oxidized, it is effective to form intermediate layers, in which W and Si are concentrated, in boundaries of graphite particles and the matrix.

Thus, the graphite-containing, heat-resistant cast iron of the present invention comprises 3.5-5.6% of Si and 1.2-15% of W on a weight basis, and has intermediate layers, in which W and Si are concentrated, in the boundaries of graphite particles and a matrix.

The graphite-containing, heat-resistant cast iron of the present invention comprises predetermined amounts of W and Si, and has intermediate layers, in which W and Si are concentrated, in boundary regions of graphite with a matrix. The intermediate layers act as protective layers (barriers) to suppress the intrusion of oxidizing gases into the graphite from outside and the diffusion of C from the graphite particles, thereby preventing the oxidation of the graphite particles and their surrounding matrix regions, and thus improving the oxidation resistance and thermal crack resistance of the heat-resistant cast iron.

In the heat-resistant cast iron of the present invention, a ratio (Xi/Xm) of the weight ratio Xi of W in the intermediate layers to the weight ratio Xm of W in the matrix both measured by FE-TEM-EDS (energy-dispersive X-ray spectroscopy) is preferably 5 or more, more preferably 10 or more. Also, a ratio (Yi/Ym) of the weight ratio Yi of Si in the intermediate layers to the weight ratio Ym of Si in the matrix both measured by FE-TEM-EDS is preferably 1.5 or more, more preferably 2.0 or more.

It preferably contains 0.005-0.2% by weight of Mg as a graphite-spheroidizing element.

Si and W preferably meet the condition of $Si+(2/7)W \leqq 8$ on a weight basis.

The heat-resistant cast iron of the present invention comprises graphite particles and W, with W-containing carbide substantially in boundaries of graphite particles and the matrix. The W-containing carbide existing substantially in boundaries of graphite particles and the matrix suppress the intrusion of oxidizing gases from outside and the diffusion of C from the graphite particles, resulting in improved oxidation resistance. Because the W-containing carbide is also formed in grain boundaries in contact with the graphite particles, in which the diffusion of oxidizing gases and C appears to occur predominantly, the diffusion of oxidizing gases and C are effectively prevented.

The number of graphite particles having W-containing carbide substantially in their boundaries with the matrix is preferably 75% or more of the total number of graphite particles. Also, the number of W-containing carbide particles substantially in boundaries of graphite particles and the matrix (represented by the number of W-containing carbide particles on the graphite particles exposed by etching) is preferably $3\times10^5/mm^2$ or more per a unit area of graphite. Further, the area ratio of W-containing carbide (determined with respect to W-containing carbide on the graphite particles exposed by etching) is preferably 1.8% or more per a unit area of graphite. The area ratio of W-containing carbide is more preferably 2% or more. How to calculate the number and area ratio of carbide particles will be explained later.

The heat-resistant cast iron of the present invention preferably has an $A_{C1}$ transformation point of 840° C. or higher when measured from 30° C. at a temperature-elevating speed of 3° C./minute. The weight loss by oxidation is preferably 60 $mg/cm^2$ or less when kept at 800° C. for 200 hours in the air, and 70 $mg/cm^2$ or less when heating and cooling are repeated 100 times between 700° C. and 850° C. The thermal cracking life is preferably 780 cycles or more, in a thermal fatigue test, in which heating and cooling are conducted under the conditions of an upper-limit temperature of 840° C., a temperature amplitude of 690° C. and a constraint ratio of 0.25. The heat-resistant cast iron of the present invention has a room-temperature elongation of preferably 1.8% or more, more preferably 2.0% or more.

The heat-resistant cast iron of the present invention preferably has a composition comprising, on a weight basis, 1.5-4.5% of C, 3.5-5.6% of Si, 3% or less of Mn, 1.2-15% of W, less than 0.5% of Ni, 0.3% or less of Cr, and 1.0% or less of a graphite-spheroidizing element, the balance being substantially Fe and inevitable impurities.

The heat-resistant cast iron of the present invention more preferably has a composition comprising, on a weight basis, 1.8-4.2% of C, 3.8-5.3% of Si, 1.5% or less of Mn, 1.5-10% of W, 0.3% or less of Ni, 0.3% or less of Cr, and 0.01-0.2% of a graphite-spheroidizing element, Si+(2/7)W≦8, and the balance being substantially Fe and inevitable impurities.

The heat-resistant cast iron of the present invention may contain, in addition to the above elements, one or more of 5.5% or less by weight of Mo, 6.5% or less by weight of Cu, and 5% or less by weight of Co. The heat-resistant cast iron of the present invention may further contain 1.0% or less by weight of Nb and/or 0.05% or less by weight of B. The heat-resistant cast iron of the present invention may further contain 0.003-0.02% by weight of S and 0.05% or less by weight of a rare earth element.

The exhaust equipment member of the present invention is formed by the above heat-resistant cast iron. The exhaust equipment member may be an exhaust manifold, a turbocharger housing, an exhaust manifold integral with a turbocharger housing, a catalyst case, an exhaust manifold integral with a catalyst case, and an exhaust outlet.

The exhaust equipment member according to a preferred embodiment of the present invention, which is used at temperatures exceeding 800° C., is formed by a heat-resistant cast iron having a composition comprising, on a weight basis, 1.5-4.5% of C, 3.5-5.6% of Si, 3% or less of Mn, 1.2-15% of W, less than 0.5% of Ni, 0.3% or less of Cr, and 1.0% or less of a graphite-spheroidizing element, Si+(2/7)W≦8, and the balance being substantially Fe and inevitable impurities, and a matrix based on a ferrite phase in an as-cast state, in which graphite is crystallized, and intermediate layers, in which W and Si are concentrated, in the boundaries of the graphite particles and the matrix, so that it has an $A_{C1}$ transformation point of 840° C. or higher when measured from 30° C. at a temperature-elevating speed of 3° C./minute, and a thermal cracking life of 780 cycles or more in a thermal fatigue test, in which heating and cooling are conducted under the conditions of an upper-limit temperature of 840° C., a temperature amplitude of 690° C. and a constraint ratio of 0.25.

The exhaust equipment member according to a further preferred embodiment of the present invention has a composition comprising, on a weight basis, 1.8-4.2% of C, 3.8-5.3% of Si, 1.5% or less of Mn, 1.5-10% of W, 0.3% or less of Ni, 0.3% or less of Cr, and 0.01-0.2% of a graphite-spheroidizing element, Si+(2/7)W≦8, and the balance being substantially Fe and inevitable impurities.

The exhaust equipment member of the present invention preferably has weight loss by oxidation of 60 mg/cm$^2$ or less when kept at 800° C. for 200 hours in the air. The exhaust equipment member of the present invention preferably has weight loss by oxidation of 70 mg/cm$^2$ or less when heating and cooling are repeated 100 times between 700° C. and 850° C.

BRIEF DESCRIPTION OF THE DRAWINGS

FIG. 11(*b*) is an FE-SEM photograph showing a carbide-measuring region S2 in FIG. 11(*a*).

FIG. 13(*b*) is an enlarged photograph of FIG. 13(*a*).

FIG. 14(*b*) is an enlarged photograph of FIG. 14(*a*).

BEST MODE FOR CARRYING OUT THE INVENTION

[1] Function of W

Figure 1:
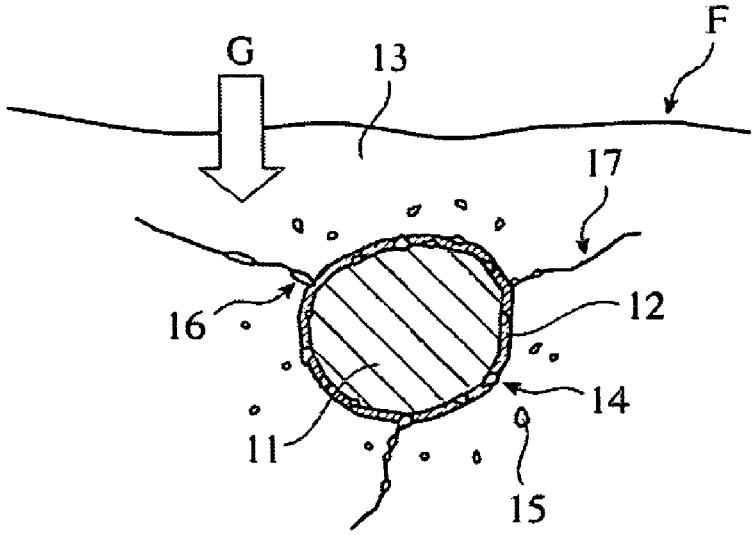
FIG. 1 is a schematic view showing a graphite particle and its surrounding structure in the heat-resistant cast iron of the present invention.
Figure 2:
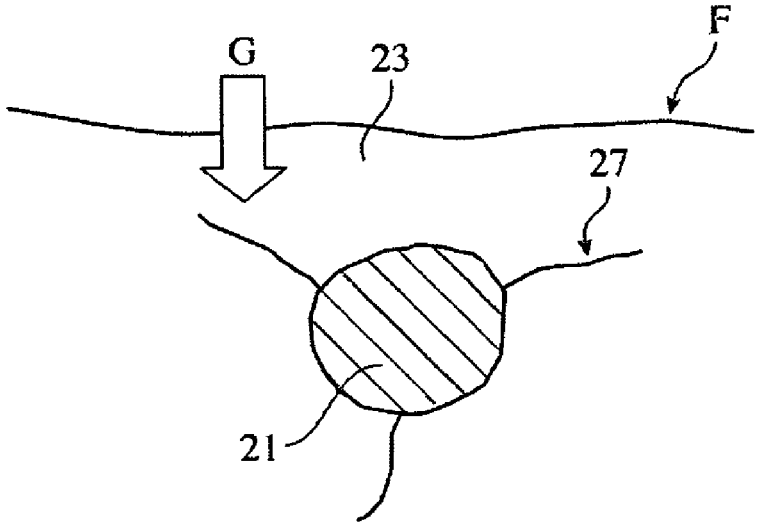
FIG. 2 is a schematic view showing a graphite particle and its surrounding structure in a conventional cast iron.

FIG. 1 is a schematic view showing graphite and its surrounding structure in the heat-resistant cast iron of the present invention, and FIG. 2 is a schematic view showing graphite and its surrounding structure in a conventional cast iron. In the conventional cast iron, an exhaust gas containing sulfur oxides, nitrogen oxides, etc., and a high-temperature, oxygen-containing gas such as oxygen, carbon dioxide and $H_2O$ gas, which are called "oxidizing gases G," diffuse into the cast iron from its surface F, causing the internal oxidation of the cast iron. Because carbon C in graphite 21 is easily diffusible, it diffuses toward the surface F, so that it is combined with oxygen in the oxidizing gas G to form CO or $CO_2$ (decarburization). Namely, the diffusion of the oxidizing gas G from the surface F toward inside and the diffusion of C from the graphite particles 21 toward outside cause oxidation and decarburization simultaneously. When decarburization occurs by the diffusion of C from the graphite particles 21, the graphite particles 21 come to have voids, into which the oxidizing gas G easily enters, so that oxidation progresses. Accordingly, if the intrusion of the oxidizing gas G into the graphite particles 21 from outside and the diffusion of C from the graphite particles 21 toward outside are suppressed, the oxidation of the cast iron can be prevented.

As shown in FIG. 1, the heat-resistant cast iron of the present invention has intermediate layers 12, in which W and Si are concentrated, in the boundaries of graphite particles 11 and the matrix 13. The intermediate layers 12 act as protective layers (barriers) to prevent the oxidizing gas from intruding into the graphite particles 11 and the diffusion of C from the graphite particles 11, thereby improving the oxidation resistance and thus thermal crack resistance of the heat-resistant cast iron. The intermediate layers 12, in which W and Si are concentrated, are formed during a solidification process in the casting, though it is considered that they are also formed in a heat treatment step and/or during use at high temperatures. W and Si are presumably concentrated in the intermediate layers 12 in the boundaries of the graphite particles 11 and the matrix 13, because of stability in energy, resulting in the intermediate layers 12 formed in the boundaries of the graphite particles 11 and the matrix 13.

W functions to form not only the intermediate layers 12 in the boundaries of the graphite particles 11 and the matrix 13, but also W-containing carbide particles 14 substantially in their boundaries (precipitation), thereby further suppressing the oxidation and the diffusion of C to improve oxidation resistance and thus thermal crack resistance. This appears to be due to the fact that C diffusing from the graphite particles 11 is combined with W substantially in the boundaries of the graphite particles 11 and the matrix 13 to form W-containing carbide particles 14, thereby suppressing C necessary for the austenitization of the matrix 13 from diffusing into the matrix 13. The term "boundaries of graphite particles and matrix" used herein means regions each straddling a boundary or an intermediate layer between a graphite particle and the matrix, ranging from about 1 μm on the graphite particle side to about 1 μm on the matrix side.

The diffusion of oxidizing gases and C and accompanying austenitization appear to occur predominantly in ferritic grain boundaries or prior austenite grain boundaries rather than in crystal grains in the matrix, but the W-containing carbide particles are formed also in the grain boundaries, so that the diffusion of oxidizing gases and C is effectively prevented. The diffusion of C from the graphite particles through the boundaries is, as shown in FIG. 1, effectively suppressed by the formation of the W-containing carbide particles 16 in the boundaries 17 in contact with the graphite particles 11.

Because W is dissolved in the matrix 13, C diffused into the matrix 13 forms fine W-containing carbide particles 15 to prevent the oxidation of C and its diffusion to outside, thereby fixing C necessary for the austenitization of the matrix 13 and thus suppressing austenitic transformation.

Because W elevates the $A_{C1}$ transformation point, it makes austenitic transformation unlikely in exhaust equipment members even when their temperature is elevated, thereby providing them with improved heat resistance. As shown in FIG. 1, this appears to be due to the fact that the austenitic transformation is suppressed, because the diffusion of C from the graphite particles 11 to the matrix 13 is hindered by the intermediate layers 12 and the W-containing carbide particles 14, 16, and because C entering into the matrix 13 forms W-containing carbide particles 15, making it less likely that C necessary for the austenitization of the matrix 13 is diffused into the matrix 13, resulting in the elevated $A_{C1}$ transformation point. In general, to elevate the $A_{C1}$ transformation point, a large amount of Si had to be added, inevitably sacrificing the room-temperature ductility. However, the inclusion of W can elevate the $A_{C1}$ transformation point without much lowering the room-temperature ductility W is concentrated in eutectic cell boundaries to form W-containing carbide particles, thereby increasing the high-temperature yield strength of the heat-resistant cast iron. Also, W lowers the eutectic temperature, thereby improving the melt fluidity (castability) of the cast iron, and decreasing a melting cost.

[2] Composition of Heat-resistant Cast Iron

The heat-resistant cast iron of the present invention comprises C, Si and a graphite-spheroidizing element as indispensable elements, in addition to W.

(1) W: 1.2-15% by Weight

The heat-resistant cast iron of the present invention should contain 1.2-15% by weight of W. W is concentrated in the boundaries of graphite particles and the matrix to form intermediate layers. It further forms W-containing carbide particles in the boundaries of graphite particles and the matrix. The intermediate layers and the W-containing carbide particles prevent the intrusion of oxidizing gases into the graphite particles and the diffusion of C from the graphite particles, thereby preventing the oxidation of the graphite particles and their surrounding matrix regions to effectively improve oxidation resistance and thus thermal crack resistance. Although it is considered that the diffusion of C occurs predominantly in grain boundaries, it is effectively suppressed by the W-containing carbide particles formed in boundaries in contact with the graphite particles. The W-concentrated intermediate layers are presumably formed during the solidification process in the casting, a heat treatment step and/or high-temperature use. W is concentrated in graphite-matrix boundaries because of stability in energy.

W exceeding 15% by weight not only fails to provide further improvement in the above effect, but also lowers the spheroidization ratio (nodularity) and the room-temperature elongation and increases materials costs. On the other hand, less than 1.2% by weight of W leads to insufficient formation of intermediate layers (expressed by thickness) and insufficient concentration of W in the intermediate layers, failing to fully improve the oxidation resistance and the thermal crack resistance. The W content is preferably 1.5-10% by weight, more preferably 2-5% by weight.

Although W is a relatively expensive alloying element like Ni used for the austenitic spheroidal graphite cast iron, the heat-resistant cast iron of the present invention containing 1.2-15% by weight of W is lower in materials costs than the austenitic spheroidal graphite cast iron containing 18-35% by weight of Ni. In addition, the inclusion of W neither deteriorates the castability, such as melt fluidity and shrinkage tendency, of the heat-resistant cast iron, nor lowers the production yield of the heat-resistant cast iron. Further, because the heat-resistant cast iron of the present invention has a non-austenitic matrix structure based on a ferrite phase in an as-cast state, it has a low linear expansion coefficient, resulting in small expansion when heated.

(2) C: 1.5-4.5% by Weight

C is an element improving melt fluidity and crystallizing graphite in the casting, like Si. When C is less than 1.5% by weight, the melt fluidity is low. When C exceeds 4.5% by weight, coarse graphite particles increase, resulting in carbon dross and more shrinkage cavities. Accordingly, the C content is 1.5-4.5% by weight, preferably 1.8-4.2% by weight, more preferably 2.5-4.0% by weight.

(3) Si: 3.5-5.6% by Weight

Si contributes to the crystallization of graphite in the casting, and functions to ferritize the matrix and elevate the $A_{C1}$ transformation point. Further, when Si is contained, a dense oxide layer is easily formed on the cast iron placed in a high-temperature oxidizing gas, resulting in providing the cast iron with improved oxidation resistance. Si is concentrated in the intermediate layers in the graphite-matrix boundaries together with W, forming protective layers in the graphite-matrix boundaries by reaction with oxidizing gases intruding from outside. Thus, Si has an increased function to suppress the oxidation of graphite particles and their surrounding matrix regions, which is caused by oxidizing gases intruding into the graphite particles, and the diffusion of C from the graphite particles. The Si-concentrated intermediate layers appear to be formed during a solidification process in the casting, a heat treatment step and/or high-temperature use. Si is concentrated in the graphite-matrix boundaries because of stability in energy. To exhibit such function effectively, the Si content should be 3.5% or more by weight. However, when Si exceeds 5.6% by weight, the cast iron has extremely decreased toughness and ductility and deteriorated machinability. Accordingly, the Si content is 3.5-5.6% by weight, preferably 3.8-5.3% by weight, more preferably 4.0-5.0% by weight.

(4) Mn: 3% or Less by Weight

Mn functions to form a dense oxide layer on the cast iron surface in an oxidizing atmosphere. When the Mn content exceeds 3% by weight, the cast iron has decreased toughness, ductility and $A_{C1}$ transformation point. Accordingly, the Mn content is 3% or less by weight, preferably 1.5% or less by weight.

(5) Graphite-spheroidizing Element: 1.0% or Less by Weight

Although the morphology of graphite per se is not restrictive in the heat-resistant cast iron of the present invention, it is preferably compact vermicular graphite, spheroidal graphite, etc. when higher oxidation resistance is required, or when properties such as room-temperature elongation, high-temperature yield strength, etc. are to be improved. To crystallize compact vermicular and/or spheroidal graphite in an as-cast state, a graphite-spheroidizing element such as Mg, Ca, rare earth elements, etc. is added in an amount of 1.0% or less by weight, preferably 0.01-0.2% by weight, more preferably 0.02-0.1% by weight. To obtain a vermicular cast iron having compact vermicular graphite, 0.005-0.02% by weight of Mg is preferably added as the graphite-spheroidizing element. To obtain a spheroidal graphite cast iron, 0.02-0.08% by weight of Mg is preferably added as the graphite-spheroidizing element.

(6) Si+(2/7)W: 8 or Less (on a Weight Basis)

Increase in both Si and W results in decrease in the ductility of the heat-resistant cast iron. Cast parts such as exhaust equipment members are subjected to mechanical vibration, or an impact or static load in their production step, their assembling to engines, during driving, etc. Accordingly, the exhaust equipment members are required to have enough ductility, lest that cracking and breakage occur by mechanical vibration, or an impact or static load. Because metal materials have lower toughness and ductility as the temperature becomes lower, room-temperature ductility is an important property together with heat resistance such as oxidation resistance and thermal crack resistance, etc. The room-temperature ductility is generally represented by room-temperature elongation. With the amounts of Si and W controlled to meet the condition of $Si+(2/7)W \leqq 8$, the exhaust equipment members can have necessary room-temperature elongation.

(7) Ni: Less than 0.5% by Weight

Ni functions to lower the $A_{C1}$ transformation point of the ferritic cast iron. When cast iron with lowered $A_{C1}$ transformation point is used at high temperatures, in which heating and cooling are repeated from room temperature to near the $A_{C1}$ transformation point or higher, secondary graphite is precipitated in the matrix, causing irreversible expansion and thus large deformation. As a result, the cast iron has decreased thermal crack resistance. The addition of Ni to the ferritic cast iron promotes internal oxidation, resulting in decreased oxidation resistance. Because such adverse effects are remarkable when the Ni content is 0.5% or more by weight, Ni is less than 0.5% by weight, preferably 0.3% or less by weight.

(8) Cr: 0.3% or Less by Weight

Cr functions to lower the $A_{C1}$ transformation point, and make the ferrite matrix extremely brittle, thereby lowering the room-temperature elongation. The exhaust equipment member should have practically sufficient ductility, lest that cracking and breakage occur in the exhaust equipment members by mechanical vibration, or an impact or static load in production processes such as casting, assembling, etc. or during use, not only at high temperatures but also at room temperature. To prevent the $A_{C1}$ transformation point from lowering and the exhaust equipment members from becoming brittle, Cr is preferably controlled to 0.3% or less by weight.

(9) S: 0.003-0.02% by Weight, and Rare Earth Element: 0.05% or Less by Weight

To obtain the spheroidal graphite cast iron, it is preferable to add 0.02-0.08% by weight of Mg while controlling the amounts of a rare earth element (RE) and S. Mg is combined with S to form MgS, a nucleus for spheroidal graphite particles, and the rare earth element is also combined with S to form RES, a nucleus for spheroidal graphite particles. The rare earth element is an element exhibiting a graphite-spheroidizing effect even in a small amount. However, the RES suffers quicker fading of a graphite-spheroidizing function than MgS, and the fading leads to decrease in the spheroidization ratio in the spheroidal graphite cast iron. The fading function of RES is remarkable particularly in thick portions in which solidification is low. Accordingly, to prevent the spheroidization ratio from decreasing by the fading of RES, it is preferable to limit the amount of the rare earth element. Specifically, the rare earth element is preferably 0.05% or less by weight.

To have a high spheroidization ratio, it is necessary to form MgS whose fading is slower than that of RES. To form MgS, 0.003% or more by weight of S is preferably added, taking into consideration the amount of S consumed by RES. However, S is an element that should usually be avoided because it hinders spheroidization when contained in an excess amount. When S exceeds 0.02% by weight, compact vermicular or flaky graphite particles are formed, resulting in decrease in the spheroidization ratio, and thus in room-temperature elongation, oxidation resistance and thermal crack resistance. Accordingly, the heat-resistant cast iron of the present invention preferably contains 0.05% or less by weight of the rare earth element and 0.003-0.02% by weight of S, in addition to 0.02-0.08% by weight of Mg. To have a higher spheroidization ratio, 0.025% or less by weight of the rare earth element and 0.005-0.018% by weight of S are preferably contained.

The heat-resistant cast iron of the present invention may contain, in addition to the above elements, Mo, Cu, Co, Nb and B alone or in combination, if necessary, to further improve oxidation resistance and thermal crack resistance, or to improve such properties as room-temperature elongation, high-temperature strength, high-temperature yield strength, thermal deformation resistance, etc. without deteriorating these properties.

(10) Mo: 5.5% or Less by Weight

Mo is combined with C in the matrix to crystallize and precipitate carbide, and to reduce an average thermal expansion coefficient, thereby reducing thermal strain (thermal stress) at high temperatures and improving the high-temperature strength of the cast iron. However, when Mo exceeds 5.5% by weight, the $A_{C1}$ transformation point is lowered, resulting in decrease in the thermal crack resistance of the cast iron, decrease in the machinability of the cast iron because of increased carbide, and deterioration in the castability of the cast iron because of increased shrinkage tendency. Accordingly, Mo is 5.5% or less by weight, preferably 4.5% or less by weight.

(11) Cu: 6.5% or Less by Weight

Cu improves the high-temperature yield strength of the cast iron. When Cu exceeds 6.5% by weight, the matrix becomes brittle, causing such problems as breakage, etc. Accordingly, Cu is 6.5% or less by weight, preferably 3.5% or less by weight.

(12) Co: 5% or Less by Weight

Although Co is a relatively expensive element, it is dissolved in a ferrite matrix to improve the high-temperature yield strength. To improve thermal deformation resistance, 5% or less by weight of Co is preferably contained. If exceeding 5% by weight, the effect would be saturated, only resulting in increase in materials costs.

(13) Nb: 1.0% or Less by Weight, B: 0.05% or Less by Weight

Both Nb and B improve the room-temperature elongation of the heat-resistant cast iron particularly by ferritization annealing. When Nb is more than 1.0% by weight, the melt exhibits poor fluidity in the casting, and gas defects are likely to be generated. When B is more than 0.05% by weight, the spheroidization ratio decreases. It is thus preferable to add 1.0% or less by weight of Nb and/or 0.05% or less by weight of B, if necessary.

(14) Other Elements

Preferably added in addition to the above elements are, if necessary, 1% or less by weight (within a range not deteriorating castability and machinability) of at least one of Ti, V, Zr and Ta, which improves the high-temperature yield strength, 0.2% or less by weight of Al, and 0.5% or less by weight [calculated as (2Sn+Sb)] of graphite-spheroidizing-ratio-improving Sn and Sb.

Although the above additional elements include elements acting to deteriorate oxidation resistance, such as V and Sb, the oxidation resistance of the W-containing, heat-resistant cast iron of the present invention is not substantially damaged as long as they are added within the above composition ranges, because the oxidation of graphite particles and their surrounding matrix regions is suppressed.

(15) Composition Examples

Specific composition examples (on a weight basis) of the heat-resistant cast iron of the present invention are as follows.

(a) General Composition Range 1.5-4.5% of C, 3.5-5.6% of Si, 3% or less of Mn, 1.2-15% of W, less than 0.5% of Ni, 0.3% or less of Cr, and 1.0% or less of a graphite-spheroidizing element, the balance being substantially Fe and inevitable impurities.

(b) Preferred Composition Range 1.8-4.2% of C, 3.8-5.3% of Si, 1.5% or less of Mn, 1.5-10% of W, 0.3% or less of Ni, 0.3% or less of Cr, and 0.01-0.2% of a graphite-spheroidizing element, the balance being substantially Fe and inevitable impurities.

(c) More Preferred Composition Range 2.5-4.0% of C, 4.0-5.0% of Si, 1.5% or less of Mn, 2-5% of W, 0.3% or less of Ni, 0.3% or less of Cr, and 0.02-0.1% of a graphite-spheroidizing element, the balance being substantially Fe and inevitable impurities.

The heat-resistant cast iron of the present invention preferably meets the condition of $Si+(2/7)W \leqq 8$. The heat-resistant cast iron of the present invention may contain 0.003-0.02%, preferably 0.005-0.018%, of S, and 0.05% or less, preferably 0.025% or less, of a rare earth element, if necessary. Mg as a graphite-spheroidizing element is preferably 0.02-0.08%.

The heat-resistant cast iron of the present invention may contain 5.5% or less, preferably 4.5% or less, of Mo, 6.5% or less, preferably 3.5% or less, of Cu, 5% or less of Co, 1.0% or less of Nb, and/or 0.05% or less of B, if necessary. The heat-resistant cast iron of the present invention may further contain 1% or less of at least one of Ti, V, Zr and Ta, 0.2% or less of Al, and 0.5% or less (as 2Sn+Sb) of Sn and/or Sb, if necessary.

[3] Structure and Properties of Heat-resistant Cast Iron

In the heat-resistant cast iron of the present invention, a ratio (Xi/Xm) of the weight ratio Xi of W in the intermediate layers to the weight ratio Xm of W in the matrix, both measured by FE-TEM-EDS (energy-dispersive X-ray spectroscopy), is desirably 5 or more. The ratio (Xi/Xm) represents how W is concentrated in the intermediate layers, and W concentrated 5 times or more can effectively prevent the intrusion of oxidizing gases and the diffusion of C. It should be noted that the weight ratio Xi of W is a value measured at an arbitrary position in the intermediate layers. The Xi/Xm is more preferably 10 or more.

The ratio (Yi/Ym) of the weight ratio Yi of Si in the intermediate layers to the weight ratio Ym of Si in the matrix, both measured by FE-TEM-EDS, is desirably 1.5 or more. The ratio (Yi/Ym) represents how Si is concentrated in the intermediate layers, and Si concentrated 1.5 times or more can effectively prevent the intrusion of oxidizing gases and the diffusion of C. It should be noted that the weight ratio Yi of Si is a value measured at an arbitrary position in the intermediate layers. The Yi/Ym is preferably 2.0 or more.

The number of graphite particles having W-containing carbide particles substantially in their boundaries with the matrix is preferably 75% or more of the total number of graphite particles. This suppresses the intrusion of oxidizing gases and the diffusion of C, thereby improving the oxidation resistance and thus thermal crack resistance of the heat-resistant cast iron. The W-containing carbide particles appear to be precipitated during a solidification process in the casting, and in a heat treatment step and/or during high-temperature use. The W-containing carbide particles appear to be formed substantially in the graphite-matrix boundaries because of stability in energy.

The larger number and area ratio of W-containing carbide particles existing in the boundaries of graphite particles and the matrix provide larger effects of suppressing the intrusion of oxidizing gases and the diffusion of C. Specifically, in the boundaries of graphite particles and the matrix, the number of W-containing carbide particles on graphite particles, which is represented by the number of W-containing carbide particles on the graphite particles exposed by etching, is preferably $3\times10^5/mm^2$ or more per a unit area of graphite, and the area ratio of W-containing carbide particles, which is determined on those on the graphite particles exposed by etching, is preferably 1.8% or more, more preferably 2% or more.

The heat-resistant cast iron of the present invention preferably has an $A_{C1}$ transformation point of 840° C. or higher when measured from 30° C. at a temperature-elevating speed of 3° C./minute. To improve the oxidation resistance and thermal crack resistance, it is necessary that the highest temperature of the exhaust equipment member, though it may be 800° C. or higher, does not exceed the $A_{C1}$ transformation point. For use as an alternative to expensive austenitic spheroidal graphite cast iron, cast stainless steel, etc., the $A_{C1}$ transformation point is preferably 840° C. or higher. In heating/cooling cycles, to which the exhaust equipment member is subjected, the temperature-elevating speed is mostly more than 3° C./minute. In general, the larger the temperature-elevating speed is, the higher the measured $A_{C1}$ transformation point tends to be. Accordingly, if the $A_{C1}$ transformation point measured at a temperature-elevating speed of 3° C./minute is 840° C. or higher, the heat resistance and durability are sufficient to actual heat-resistant parts such as exhaust equipment members, etc. Because the heat-resistant cast iron of the present invention has an $A_{C1}$ transformation point of 840° C. or higher when measured from 30° C. as room temperature at a temperature-elevating speed of 3° C./minute, it has excellent oxidation resistance and thermal crack resistance, so that it exhibits high durability and long life when used for exhaust equipment members subjected to the repetition of heating and cooling from room temperature to temperatures exceeding 800° C. by an exhaust gas.

When the heat-resistant cast iron of the present invention is kept at 800° C. for 200 hours in the air, the weight loss by oxidation is preferably 60 mg/cm$^2$ or less. The exhaust equipment member exposed to oxidizing gases is oxidized, so that cracking occurs from the formed oxide layers, and that oxidation-accelerating cracks propagate inside the parts and finally penetrate them. When the cast iron is used for an exhaust equipment member exposed to an exhaust gas at 700° C. or higher, particularly near 900° C., the temperature of the exhaust equipment member reaches 800° C. or higher. Accordingly, if the weight loss by oxidation of the cast iron exceeds 60 mg/cm$^2$ when placed in the air at 800° C. for 200 hours so that it is heated to 800° C., a large amount of oxide layers, from which cracking occurs, are formed, resulting in insufficient oxidation resistance. If the weight loss by oxidation is 60 mg/cm$^2$ or less when kept at 800° C. for 200 hours in the air, the formation of oxide layers and cracks is suppressed, resulting in the heat-resistant cast iron with excellent oxidation resistance and thermal crack resistance, high heat resistance and durability, and long life. The weight loss by oxidation of the heat-resistant cast iron of the present invention is more preferably 50 mg/cm$^2$ or less, most preferably 36 mg/cm$^2$ or less.

When heating and cooling are repeated 100 times between 700° C. and 850° C., the heat-resistant cast iron of the present invention preferably suffers weight loss by oxidation of 70 mg/cm$^2$ or less. An exhaust equipment member exposed to oxidizing gases has an oxide layer formed on the surface. When the oxide layer is repeatedly heated by contact with a high-temperature exhaust gas, cracking and the peeling of oxide layers occur due to the difference in thermal expansion between the oxide layers and the matrix. Peeled oxide layers contaminate other parts, causing troubles and deteriorating the reliability of an engine. Accordingly, the exhaust equipment member is required to have excellent oxidation resistance making it resistant to the formation and peeling of oxide layers and cracking even under repeated heating. When the cast iron is used for an exhaust equipment member exposed to an exhaust gas at 700° C. or higher, particularly near 900° C., the temperature of the exhaust equipment member reaches 800° C. or higher. If the weight loss by oxidation exceeds 70 mg/cm$^2$ when the cast iron is repeatedly heated and cooled between 700° C. and 850° C. 100 times, a lot oxide layers are formed, and the resultant oxide layers easily peel off, resulting in insufficient oxidation resistance. If the weight loss by oxidation is 70 mg/cm$^2$ or less when heating and cooling are repeated between 700° C. and 850° C. 100 times, the formation and peeling of oxide layers and cracking are suppressed, resulting in the heat-resistant cast iron with excellent oxidation resistance and thermal crack resistance, high heat resistance and durability, and long life. The heat-resistant cast iron of the present invention preferably suffers weight loss by oxidation of 60 mg/cm$^2$ or less when heated and cooled.

The heat-resistant cast iron of the present invention preferably has a thermal cracking life of 780 cycles or more in a thermal fatigue test comprising heating and cooling in the air under the conditions of an upper limit temperature of 840° C., a temperature amplitude of 690° C. and a constraint ratio of 0.25. In addition to the oxidation resistance and the thermal crack resistance, the exhaust equipment member is required to have a long thermal cracking life in the repetition of operation (heating) and stop (cooling) of an engine. The thermal cracking life is one of measures for representing how high the heat resistance is, which is expressed by the number of heating/cooling cycles until cracking causes thermal fatigue fracture in a thermal fatigue test. The exhaust equipment member exposed to an exhaust gas at 700° C. or higher, particularly near 900° C. becomes 800° C. or higher. If the thermal cracking life were less than 780 cycles under the above conditions, the cast iron would not have enough life until thermal fatigue fracture occurs when used for exhaust equipment members. Long-life, heat-resistant parts such as exhaust equipment members, etc. are formed by the heat-resistant cast iron of the present invention having a thermal cracking life of 780 cycles or more. The heat-resistant cast iron of the present invention more preferably has a thermal cracking life of 800 cycles or more.

The heat-resistant cast iron of the present invention preferably has room-temperature elongation of 1.8% or more. Exhaust equipment members for automobile engines formed by the heat-resistant cast iron of the present invention are repeatedly heated and cooled from room temperature to temperatures exceeding 800° C., so that they are subjected to thermal stress due to the repetition of expansion during heating and shrinkage during cooling. Accordingly, the heat-resistant cast iron should have such room-temperature ductility (room-temperature elongation) as to resist tensile stress due to the shrinkage caused by cooling from a high temperatures to room temperature. If it has poor room-temperature elongation, it is vulnerable to cracking and breakage, resulting in an insufficient thermal cracking life. In addition, the exhaust equipment members are likely to be cracked and broken by mechanical vibration, or an impact or static load during their production and assembling to engines at room temperature, driving of automobiles, etc.

When the room-temperature elongation of the heat-resistant cast iron is less than 1.8%, cracking and breakage due to thermal stress are likely to occur, resulting in an insufficient thermal cracking life, and failing to have practically sufficient ductility to prevent cracking and breakage due to mechanical vibration, or an impact or static load at room temperature. When the room-temperature elongation is 1.8% or more, cracking and breakage are suppressed, resulting in the heat-resistant cast iron with excellent thermal crack resistance (thermal cracking life) and practically sufficient ductility. The heat-resistant cast iron of the present invention more preferably has room-temperature elongation of 2.0% or more.

To improve the room-temperature elongation, it is effective to increase the spheroidization ratio. The spheroidization ratio is desirably 30% or more in the case of vermicular cast iron, and 70% or more in the case of spheroidal graphite cast iron.

Although the heat-resistant cast iron of the present invention exhibits the above properties in an as-cast state, it is preferably subjected to a heat treatment to remove residual stress generated during the casting and to make the matrix structure uniform. Specifically, the residual stress generated during the casting can be removed by keeping the cast iron at 600° C. or higher, and annealing it for ferritization by furnace- or air-cooling. To make the matrix structure uniform and control the hardness of the cast iron, it is preferable to keep the cast iron at 700° C. or higher. When the heat treatment is conducted, the addition of Nb and/or B is effective to improve the room-temperature elongation. The above heat treatment is also effective to form thick intermediate layers, in which W and Si are concentrated, in as-cast graphite-matrix boundaries, and to increase the number and area ratio of W-containing carbide particles formed substantially in graphite-matrix boundaries including boundaries in contact with graphite particles, etc. The heat treatment time may be properly determined depending on the size of the exhaust equipment member.

[4] Exhaust Equipment Member

The exhaust equipment member of the present invention, which can be used at temperatures exceeding 800° C., is formed by a heat-resistant cast iron having a composition comprising, on a weight basis, 1.5-4.5% of C, 3.5-5.6% of Si, 3% or less of Mn, 1.2-15% of W, less than 0.5% of Ni, 0.3% or less of Cr, and 1.0% or less of a graphite-spheroidizing element, $Si+(2/7)W \leqq 8$, and the balance being substantially Fe and inevitable impurities, and a structure comprising graphite crystallized in a matrix based on a ferrite phase in an as-cast state, and intermediate layers, in which W and Si are concentrated, in graphite-matrix boundaries, so that it has $A_{C1}$ transformation point of 840° C. or higher when measured from 30° C. at a temperature-elevating speed of 3° C./minute, and a thermal cracking life of 780 cycles or more in a thermal fatigue test, in which heating and cooling are conducted under the conditions of an upper-limit temperature of 840° C., a temperature amplitude of 690° C. and a constraint ratio of 0.25.

Such exhaust equipment member may be exemplified as an exhaust manifold, a turbocharger housing, an exhaust manifold integral with a turbocharger housing, a catalyst case, an exhaust manifold integral with a catalyst case, an exhaust outlet, etc. The exhaust equipment member of the present invention can be used for a high-temperature exhaust gas, for which conventional high-Si spheroidal graphite cast iron would not be able to be used. Specifically, the exhaust equipment member formed by the heat-resistant cast iron of the present invention has a long life even when it is exposed to an exhaust gas at 700° C. or higher, particularly near 900° C., so that it is repeatedly heated and cooled from room temperature to temperatures exceeding 800° C.

Figure 16:
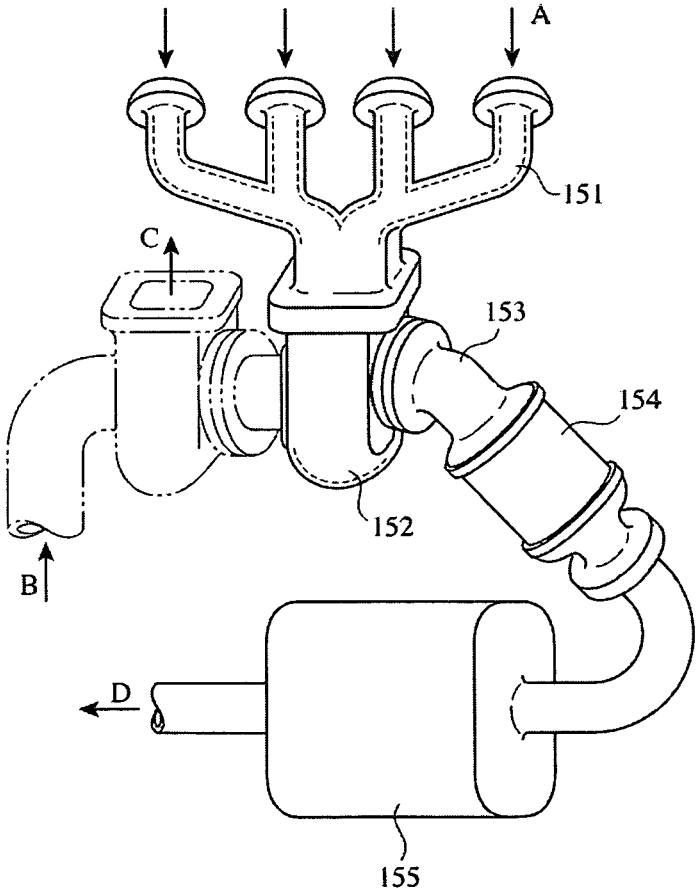
FIG. 16 is a perspective view showing an exhaust equipment member comprising an exhaust manifold, a turbocharger housing and a catalyst case.

FIG. 16 shows an exhaust equipment member comprising an exhaust manifold 151, a turbocharger housing 152, and a catalyst case 154. In this exhaust equipment member, an exhaust gas (indicated by the arrow A) discharged from engine cylinders (not shown) is gathered in the exhaust manifold 151 to rotate a turbine (not shown) in the turbine housing 152 by the kinetic energy of the exhaust gas, and the air (indicated by the arrow B) supplied by driving a compressor coaxially connected to this turbine is compressed to supply the compressed air to the engine as shown by the arrow C, thereby increasing the power of the engine. An exhaust gas discharged from the turbocharger housing 152 is supplied to the catalyst case 154 via a connection 153, and after harmful materials are removed by a catalyst in the catalyst case 154, it is discharged to the air via a muffler 155 as shown by the arrow D. Main parts are as thick as 2.0-4.5 mm in the exhaust manifold 151, 2.5-5.5 mm in the turbocharger housing 152, 2.5-3.5 mm in the connection 153, and 2.0-2.5 mm in the catalyst case 154.

As long as these parts are castable, they may be integrally formed, for instance, as an exhaust manifold integral with a turbocharger housing, an exhaust manifold integral with a catalyst case.

Though the heat-resistant cast iron of the present invention contains W, it enjoys lower materials costs with good castability and machinability than high-quality materials such as austenitic spheroidal graphite cast iron and cast stainless steel. Accordingly, the exhaust equipment member made of the heat-resistant cast iron of the present invention can be produced at a higher yield and a lower cost without needing high production technologies.

The present invention will be explained in more detail referring to Examples below without intention of restricting the present invention thereto.

EXAMPLES 1-74, COMPARATIVE EXAMPLES 1-16, AND CONVENTIONAL EXAMPLES 1-6

Each cast iron having a chemical composition (% by weight) shown in Table 1 was melted in an $SiO_2$-lined, 100-kg, high-frequency furnace in the air, tapped from the furnace at 1450° C. or higher, and spheroidized by a sandwiching method using commercially available Fe—Si—Mg. Immediately thereafter, it was poured at 1300° C. or higher into a Y-block mold. After shake-out, each sample was shot-blasted, and annealed for ferritization by keeping it at a temperature of 600-940° C. as shown in Table 2 for 3 hours, and then cooling it in the furnace. Incidentally, no heat treatment was conducted on the samples of Example 9, Comparative Examples 1 and 9, and Conventional Examples 1, 2 and 4, and annealing for ferritization was conducted not by furnace-cooling but by air-cooling in the sample of Comparative Example 2. The samples of Conventional Examples 5 and 6 were spheroidized by a sandwiching method using commercially available Ni—Mg, heat-treated at 910° C. for 4 hours and then air-cooled. The samples of Examples 8 and 9 and Comparative Examples 8 and 9 were produced by casting the same melt under the same conditions except for whether or not the heat treatment was conducted. The samples of Comparative Examples 1-10 contained less than 1.2% by weight of W, and the samples of Comparative Examples 11-13 contained more than 15% by weight of W. Also, the samples of Comparative Examples 14 and 15 contained less than 3.5% by weight of Si, and the sample of Comparative Example 16 contained more than 5.6% by weight of Si. It should be noted that the balance of the chemical composition shown in Table 1 is substantially Fe and inevitable impurities.

The samples of Conventional Examples 1-6 were produced from the following materials.

Conventional Example 1: FCD450 of JIS.

CONVENTIONAL EXAMPLE 2: Mo-containing, high-Si, spheroidal graphite cast iron (Hi-SiMo).

CONVENTIONAL EXAMPLE 3: Heat-resistant spheroidal graphite cast iron described in JP9-87796A.

CONVENTIONAL EXAMPLE 4: Ferritic, spheroidal graphite cast iron described in JP2002-339033A.

CONVENTIONAL EXAMPLE 5: NI-RESIST D2 (austenitic spheroidal graphite cast iron).

CONVENTIONAL EXAMPLE 6: NI-RESIST D5S (austenitic spheroidal graphite cast iron).

TABLE 1

| No. | Composition (% by weight) | | | | | | | | |
|---|---|---|---|---|---|---|---|---|---|
| | C | Si | Mn | W | Ni | Cr | Si + (2/7)W | S | Spheroidizing Elements[1] |
| Example 1 | 3.33 | 3.60 | 0.51 | 1.26 | — | — | 3.96 | 0.006 | 0.051 |
| Example 2 | 3.23 | 3.50 | 0.55 | 1.50 | — | — | 3.93 | 0.006 | 0.052 |
| Example 3 | 3.06 | 3.54 | 0.44 | 2.10 | — | — | 4.14 | 0.007 | 0.048 |
| Example 4 | 3.37 | 3.83 | 0.58 | 1.52 | — | — | 4.26 | 0.006 | 0.064 |
| Example 5 | 3.42 | 3.81 | 0.52 | 2.08 | — | — | 4.40 | 0.009 | 0.058 |
| Example 6 | 3.33 | 4.11 | 0.50 | 1.55 | — | — | 4.55 | 0.009 | 0.065 |
| Example 7 | 3.06 | 4.08 | 0.41 | 2.20 | — | — | 4.71 | 0.011 | 0.055 |
| Example 8 | 2.90 | 4.59 | 0.45 | 2.95 | — | — | 5.43 | 0.010 | 0.051 |
| Example 9 | 2.90 | 4.59 | 0.45 | 2.95 | — | — | 5.43 | 0.010 | 0.051 |
| Example 10 | 3.00 | 4.71 | 0.46 | 3.06 | — | — | 5.58 | 0.008 | 0.055 |
| Example 11 | 2.90 | 4.62 | 0.45 | 4.83 | — | — | 6.00 | 0.016 | 0.056 |
| Example 12 | 3.04 | 4.66 | 0.44 | 4.98 | — | — | 6.08 | 0.008 | 0.070 |
| Example 13 | 3.20 | 4.65 | 0.55 | 9.56 | — | — | 7.38 | 0.012 | 0.053 |
| Example 14 | 3.00 | 4.56 | 0.45 | 14.7 | — | — | 8.76 | 0.010 | 0.061 |
| Example 15 | 2.78 | 5.60 | 0.89 | 1.50 | — | — | 6.03 | 0.010 | 0.059 |
| Example 16 | 3.52 | 3.58 | 0.49 | 1.23 | 0.29 | — | 3.93 | 0.009 | 0.06 |
| Example 17 | 3.60 | 3.55 | 0.51 | 1.21 | 0.48 | — | 3.90 | 0.011 | 0.056 |
| Example 18 | 3.33 | 3.56 | 0.46 | 1.24 | 0.59 | — | 3.91 | 0.008 | 0.061 |
| Example 19 | 2.55 | 5.54 | 0.43 | 14.7 | 0.55 | — | 9.74 | 0.006 | 0.059 |
| Example 20 | 2.94 | 3.56 | 0.41 | 1.26 | — | 0.29 | 3.92 | 0.012 | 0.056 |
| Example 21 | 2.87 | 3.52 | 0.39 | 1.24 | — | 0.36 | 3.87 | 0.007 | 0.053 |
| Example 22 | 3.05 | 3.57 | 0.45 | 1.22 | 0.30 | 0.27 | 3.92 | 0.009 | 0.061 |
| Example 23 | 3.11 | 3.54 | 0.43 | 1.21 | 0.49 | 0.30 | 3.89 | 0.010 | 0.063 |
| Example 24 | 3.50 | 4.01 | 0.11 | 2.41 | — | — | 4.70 | 0.008 | 0.059 |
| Example 25 | 2.90 | 5.30 | 1.10 | 1.48 | — | — | 5.72 | 0.010 | 0.049 |
| Example 26 | 3.11 | 4.57 | 0.55 | 2.89 | — | — | 5.40 | 0.011 | 0.033 |
| Example 27 | 3.40 | 4.50 | 0.45 | 1.21 | — | — | 4.85 | 0.008 | 0.054 |
| Example 28 | 3.30 | 4.51 | 0.70 | 1.60 | — | — | 4.97 | 0.007 | 0.060 |
| Example 29 | 3.35 | 4.66 | 0.65 | 1.54 | — | — | 5.10 | 0.010 | 0.047 |
| Example 30 | 3.00 | 4.51 | 0.45 | 2.87 | — | — | 5.33 | 0.008 | 0.059 |
| Example 31 | 3.10 | 4.34 | 0.45 | 2.92 | — | — | 5.17 | 0.007 | 0.053 |
| Example 32 | 3.30 | 4.36 | 0.45 | 2.64 | — | — | 5.11 | 0.006 | 0.055 |
| Example 33 | 3.24 | 4.42 | 0.49 | 2.70 | — | — | 5.19 | 0.011 | 0.057 |
| Example 34 | 3.00 | 4.69 | 0.45 | 3.12 | — | — | 5.58 | 0.011 | 0.063 |
| Example 35 | 3.00 | 4.61 | 0.45 | 3.33 | — | — | 5.56 | 0.010 | 0.058 |
| Example 36 | 3.10 | 4.61 | 0.71 | 1.23 | — | — | 4.96 | 0.011 | 0.064 |
| Example 37 | 3.06 | 4.67 | 0.45 | 1.21 | — | — | 5.02 | 0.009 | 0.055 |
| Example 38 | 2.99 | 4.66 | 0.44 | 1.66 | — | — | 5.13 | 0.012 | 0.082 |
| Example 39 | 3.04 | 4.59 | 0.42 | 1.54 | — | — | 5.03 | 0.012 | 0.080 |

Note:
[1]Graphite-spheroidizing elements (Mg + Ca + REM).

| No. | Composition (% by weight) | | | | | | | | |
|---|---|---|---|---|---|---|---|---|---|
| | Mg | Ca | REM | Mo | Cu | Co | Nb | B | Others |
| Example 1 | 0.036 | 0.0010 | 0.014 | — | — | — | — | — | — |
| Example 2 | 0.037 | 0.0011 | 0.014 | 0.9 | — | — | — | — | — |
| Example 3 | 0.036 | 0.0011 | 0.011 | — | — | — | — | — | — |
| Example 4 | 0.041 | 0.0011 | 0.022 | — | — | — | — | — | — |
| Example 5 | 0.038 | 0.0024 | 0.018 | — | — | — | — | — | — |
| Example 6 | 0.042 | 0.0012 | 0.022 | — | — | — | — | — | — |
| Example 7 | 0.036 | 0.0012 | 0.018 | 1.0 | — | — | — | — | — |
| Example 8 | 0.040 | 0.0010 | 0.010 | 0.5 | — | — | — | — | — |
| Example 9 | 0.040 | 0.0010 | 0.010 | 0.5 | — | — | — | — | — |
| Example 10 | 0.039 | 0.0010 | 0.015 | — | — | — | — | — | — |
| Example 11 | 0.042 | 0.0012 | 0.013 | 0.5 | — | — | — | — | — |
| Example 12 | 0.049 | 0.0011 | 0.020 | — | — | — | — | — | — |
| Example 13 | 0.038 | 0.0012 | 0.014 | 0.4 | — | — | — | — | — |
| Example 14 | 0.039 | 0.0012 | 0.021 | 0.5 | — | — | — | — | — |
| Example 15 | 0.039 | 0.0021 | 0.018 | 0.4 | — | — | — | — | — |
| Example 16 | 0.048 | 0.0010 | 0.011 | — | — | — | — | — | — |
| Example 17 | 0.041 | 0.0013 | 0.014 | — | — | — | — | — | — |
| Example 18 | 0.045 | 0.0014 | 0.015 | — | — | — | — | — | — |
| Example 19 | 0.044 | 0.0023 | 0.013 | — | — | — | — | — | — |
| Example 20 | 0.041 | 0.0024 | 0.013 | — | — | — | — | — | — |
| Example 21 | 0.039 | 0.0025 | 0.011 | — | — | — | — | — | — |
| Example 22 | 0.042 | 0.0033 | 0.016 | — | — | — | — | — | — |
| Example 23 | 0.046 | 0.0033 | 0.014 | — | — | — | — | — | — |
| Example 24 | 0.045 | 0.0033 | 0.011 | — | — | — | — | — | — |
| Example 25 | 0.038 | 0.0016 | 0.010 | 0.4 | — | — | — | — | — |
| Example 26 | 0.014 | 0.0011 | 0.018 | — | — | — | — | — | — |
| Example 27 | 0.041 | 0.0010 | 0.012 | 4.4 | — | — | — | — | — |
| Example 28 | 0.048 | 0.0010 | 0.011 | 5.2 | — | — | — | — | — |

TABLE 1-continued

| | | | | | | | | | |
|---|---|---|---|---|---|---|---|---|---|
| Example 29 | 0.033 | 0.0010 | 0.013 | 5.6 | — | — | — | — | — |
| Example 30 | 0.040 | 0.0010 | 0.018 | — | 0.13 | — | — | — | — |
| Example 31 | 0.033 | 0.0021 | 0.018 | — | 3.5 | — | — | — | — |
| Example 32 | 0.036 | 0.0015 | 0.017 | — | 6.1 | — | — | — | — |
| Example 33 | 0.037 | 0.0020 | 0.018 | — | 6.8 | — | — | — | — |
| Example 34 | 0.045 | 0.0012 | 0.017 | 0.3 | 0.1 | 2.85 | — | — | — |
| Example 35 | 0.041 | 0.0010 | 0.016 | — | — | 4.98 | — | — | — |
| Example 36 | 0.047 | 0.0010 | 0.016 | — | — | — | 0.760 | — | — |
| Example 37 | 0.040 | 0.0010 | 0.014 | — | — | — | — | 0.02 | — |
| Example 38 | 0.066 | 0.0010 | 0.015 | — | — | — | 0.100 | 0.01 | — |
| Example 39 | 0.065 | 0.0012 | 0.014 | 0.5 | 0.25 | — | — | 0.02 | — |

| | Composition (% by weight) | | | | | | | | |
|---|---|---|---|---|---|---|---|---|---|
| No.[1] | C | Si | Mn | W | Ni | Cr | Si + (2/7)W | S | Spheroidizing Elements[2] |
| Comp. Ex. 1 | 3.20 | 2.03 | 0.15 | 0.09 | — | — | 2.06 | 0.006 | 0.056 |
| Comp. Ex. 2 | 3.30 | 3.53 | 0.36 | 0.20 | — | — | 3.59 | 0.007 | 0.052 |
| Comp. Ex. 3 | 3.30 | 4.61 | 0.33 | 0.51 | — | — | 4.76 | 0.008 | 0.053 |
| Comp. Ex. 4 | 3.00 | 4.78 | 0.44 | 0.78 | — | — | 5.00 | 0.012 | 0.068 |
| Comp. Ex. 5 | 3.21 | 3.54 | 0.48 | 1.12 | — | — | 3.86 | 0.008 | 0.052 |
| Comp. Ex. 6 | 2.55 | 5.55 | 0.46 | 0.90 | — | — | 5.81 | 0.012 | 0.053 |
| Comp. Ex. 7 | 3.20 | 4.66 | 0.35 | 1.02 | — | — | 4.95 | 0.010 | 0.064 |
| Comp. Ex. 8 | 3.01 | 4.65 | 0.51 | 1.06 | — | — | 4.95 | 0.011 | 0.053 |
| Comp. Ex. 9 | 3.01 | 4.65 | 0.51 | 1.06 | — | — | 4.95 | 0.011 | 0.053 |
| Comp. Ex. 10 | 3.40 | 4.56 | 0.75 | 1.10 | — | — | 4.87 | 0.011 | 0.057 |
| Comp. Ex. 11 | 3.00 | 4.51 | 0.45 | 15.22 | — | — | 8.86 | 0.011 | 0.060 |
| Comp. Ex. 12 | 3.22 | 3.55 | 0.48 | 15.41 | — | — | 7.95 | 0.007 | 0.053 |
| Comp. Ex. 13 | 2.66 | 5.56 | 0.55 | 15.36 | — | — | 9.95 | 0.009 | 0.057 |
| Comp. Ex. 14 | 3.54 | 3.27 | 0.50 | 1.22 | — | — | 3.62 | 0.006 | 0.056 |
| Comp. Ex. 15 | 3.35 | 3.34 | 0.45 | 14.90 | — | — | 7.60 | 0.006 | 0.045 |
| Comp. Ex. 16 | 3.01 | 5.72 | 0.48 | 1.23 | — | — | 6.07 | 0.007 | 0.035 |
| Con. Ex. 1 | 3.70 | 2.30 | 0.35 | <0.001 | — | — | 2.30 | 0.008 | 0.067 |
| Con. Ex. 2 | 3.20 | 4.01 | 0.50 | <0.001 | — | — | 4.01 | 0.008 | 0.057 |
| Con. Ex. 3 | 2.90 | 4.65 | 0.48 | <0.001 | 0.30 | 0.52 | 4.65 | 0.007 | 0.058 |
| Con. Ex. 4 | 3.20 | 4.30 | 0.50 | <0.001 | — | — | 4.30 | 0.011 | 0.058 |
| Con. Ex. 5 | 3.20 | 2.90 | 0.75 | <0.001 | 19.40 | 1.80 | 2.90 | 0.008 | 0.044 |
| Con. Ex. 6 | 2.00 | 5.06 | 0.51 | <0.001 | 35.1 | 1.74 | 5.06 | 0.008 | 0.062 |

Note:
[1]"Comp. Ex." represents Comparative Example, and "Con. Ex." represents Conventional Example.
[2]Graphite-spheroidizing elements (Mg + Ca + REM).

| | Composition (% by weight) | | | | | | | | |
|---|---|---|---|---|---|---|---|---|---|
| No.[1] | Mg | Ca | REM | Mo | Cu | Co | Nb | B | Others |
| Comp. Ex. 1 | 0.041 | 0.0011 | 0.014 | 0.6 | — | — | — | — | — |
| Comp. Ex. 2 | 0.036 | 0.0012 | 0.015 | 0.3 | — | — | — | — | — |
| Comp. Ex. 3 | 0.036 | 0.0013 | 0.016 | 0.4 | — | — | — | — | — |
| Comp. Ex. 4 | 0.049 | 0.0011 | 0.018 | 0.4 | — | — | — | — | — |
| Comp. Ex. 5 | 0.029 | 0.0012 | 0.022 | — | — | — | — | — | — |
| Comp. Ex. 6 | 0.033 | 0.0015 | 0.018 | — | — | — | — | — | — |
| Comp. Ex. 7 | 0.046 | 0.0025 | 0.015 | — | — | — | — | — | — |
| Comp. Ex. 8 | 0.031 | 0.0023 | 0.020 | 0.4 | — | — | — | — | — |
| Comp. Ex. 9 | 0.031 | 0.0023 | 0.020 | 0.4 | — | — | — | — | — |
| Comp. Ex. 10 | 0.041 | 0.0012 | 0.015 | 2.5 | — | — | — | — | — |
| Comp. Ex. 11 | 0.039 | 0.0012 | 0.020 | 0.5 | — | — | — | — | — |
| Comp. Ex. 12 | 0.035 | 0.0023 | 0.016 | — | — | — | — | — | — |
| Comp. Ex. 13 | 0.038 | 0.0013 | 0.018 | — | — | — | — | — | — |
| Comp. Ex. 14 | 0.041 | 0.0013 | 0.014 | — | — | — | — | — | — |
| Comp. Ex. 15 | 0.028 | 0.0014 | 0.016 | — | — | — | — | — | — |
| Comp. Ex. 16 | 0.020 | 0.0030 | 0.012 | — | — | — | — | — | — |
| Con. Ex. 1 | 0.038 | 0.0010 | 0.028 | — | 0.19 | — | — | — | — |
| Con. Ex. 2 | 0.042 | 0.0010 | 0.014 | 0.5 | — | — | — | — | — |
| Con. Ex. 3 | 0.038 | 0.0015 | 0.018 | 0.7 | — | — | — | — | — |
| Con. Ex. 4 | 0.038 | 0.0015 | 0.018 | 0.5 | — | — | — | — | V: 0.41 |
| Con. Ex. 5 | 0.040 | 0.0012 | 0.003 | — | — | — | — | — | — |
| Con. Ex. 6 | 0.058 | 0.0012 | 0.003 | — | — | — | — | — | — |

Note:
[1]"Comp. Ex." represents Comparative Example, and "Con. Ex." represents Conventional Example.

| | Composition (% by weight) | | | | | | | | |
|---|---|---|---|---|---|---|---|---|---|
| No. | C | Si | Mn | W | Ni | Cr | Si + (2/7) W | S | Spheroidizing Elements[1] |
| Example 40 | 3.02 | 4.67 | 0.51 | 2.75 | — | — | 5.46 | 0.001 | 0.045 |
| Example 41 | 3.36 | 4.43 | 0.50 | 2.86 | — | — | 5.25 | 0.002 | 0.052 |

TABLE 1-continued

| | | | | | | | | | |
|---|---|---|---|---|---|---|---|---|---|
| Example 42 | 3.22 | 4.70 | 0.46 | 3.01 | — | — | 5.56 | 0.003 | 0.041 |
| Example 43 | 2.88 | 4.51 | 0.48 | 3.03 | — | — | 5.38 | 0.005 | 0.040 |
| Example 44 | 2.99 | 4.49 | 0.51 | 2.93 | — | — | 5.33 | 0.017 | 0.042 |
| Example 45 | 3.01 | 4.64 | 0.55 | 2.87 | — | — | 5.46 | 0.020 | 0.048 |
| Example 46 | 3.24 | 4.56 | 0.54 | 2.74 | — | — | 5.34 | 0.028 | 0.042 |
| Example 47 | 3.05 | 4.51 | 0.55 | 2.90 | — | — | 5.34 | 0.001 | 0.064 |
| Example 48 | 3.13 | 4.47 | 0.52 | 3.13 | — | — | 5.36 | 0.002 | 0.060 |
| Example 49 | 2.99 | 4.62 | 0.49 | 3.04 | — | — | 5.49 | 0.003 | 0.062 |
| Example 50 | 3.01 | 4.66 | 0.53 | 3.21 | — | — | 5.58 | 0.006 | 0.067 |
| Example 51 | 3.00 | 4.71 | 0.54 | 2.50 | — | — | 5.42 | 0.018 | 0.066 |
| Example 52 | 3.22 | 4.39 | 0.55 | 3.10 | — | — | 5.28 | 0.020 | 0.071 |
| Example 53 | 2.84 | 4.55 | 0.64 | 2.95 | — | — | 5.39 | 0.028 | 0.052 |
| Example 54 | 3.11 | 4.63 | 0.45 | 2.88 | — | — | 5.45 | 0.001 | 0.087 |
| Example 55 | 3.09 | 4.52 | 0.53 | 3.05 | — | — | 5.39 | 0.002 | 0.083 |
| Example 56 | 3.15 | 4.66 | 0.44 | 2.77 | — | — | 5.45 | 0.003 | 0.093 |
| Example 57 | 3.31 | 4.58 | 0.51 | 3.10 | — | — | 5.47 | 0.006 | 0.089 |
| Example 58 | 3.14 | 4.62 | 0.45 | 2.67 | — | — | 5.38 | 0.017 | 0.091 |
| Example 59 | 3.02 | 4.47 | 0.56 | 2.99 | — | — | 5.32 | 0.020 | 0.088 |
| Example 60 | 3.08 | 4.65 | 0.66 | 3.04 | — | — | 5.52 | 0.027 | 0.082 |
| Example 61 | 2.99 | 4.47 | 0.61 | 2.78 | — | — | 5.26 | 0.001 | 0.090 |
| Example 62 | 3.12 | 4.53 | 0.54 | 2.86 | — | — | 5.35 | 0.002 | 0.112 |
| Example 63 | 3.01 | 4.65 | 0.62 | 2.98 | — | — | 5.50 | 0.003 | 0.100 |
| Example 64 | 3.15 | 4.66 | 0.46 | 2.78 | — | — | 5.45 | 0.006 | 0.101 |
| Example 65 | 2.99 | 4.62 | 0.49 | 2.65 | — | — | 5.38 | 0.017 | 0.092 |
| Example 66 | 3.03 | 4.47 | 0.51 | 2.78 | — | — | 5.26 | 0.020 | 0.119 |
| Example 67 | 3.01 | 4.76 | 0.50 | 2.89 | — | — | 5.59 | 0.027 | 0.099 |
| Example 68 | 2.91 | 4.55 | 0.49 | 14.92 | — | — | 8.81 | 0.005 | 0.040 |
| Example 69 | 3.03 | 4.60 | 0.57 | 14.89 | — | — | 8.85 | 0.020 | 0.045 |
| Example 70 | 3.04 | 4.52 | 0.52 | 14.51 | — | — | 8.67 | 0.002 | 0.083 |
| Example 71 | 3.28 | 4.55 | 0.53 | 14.78 | — | — | 8.77 | 0.005 | 0.087 |
| Example 72 | 2.99 | 4.48 | 0.57 | 14.85 | — | — | 8.72 | 0.020 | 0.091 |
| Example 73 | 3.10 | 4.68 | 0.68 | 14.43 | — | — | 8.80 | 0.025 | 0.085 |
| Example 74 | 3.03 | 4.64 | 0.51 | 14.82 | — | — | 8.87 | 0.018 | 0.098 |

Note:
(1)Graphite-spheroidizing elements (Mg + Ca + REM).

| | Composition (% by weight) | | | | | | | | |
|---|---|---|---|---|---|---|---|---|---|
| No. | Mg | Ca | REM | Mo | Cu | Co | Nb | B | Others |
| Example 40 | 0.041 | 0.0010 | 0.003 | — | — | — | — | — | — |
| Example 41 | 0.045 | 0.0025 | 0.004 | — | — | — | — | — | — |
| Example 42 | 0.036 | 0.0023 | 0.003 | — | — | — | — | — | — |
| Example 43 | 0.038 | 0.0014 | 0.001 | — | — | — | — | — | — |
| Example 44 | 0.039 | 0.0014 | 0.002 | — | — | — | — | — | — |
| Example 45 | 0.044 | 0.0014 | 0.003 | — | — | — | — | — | — |
| Example 46 | 0.036 | 0.0015 | 0.005 | — | — | — | — | — | — |
| Example 47 | 0.045 | 0.0011 | 0.018 | — | — | — | — | — | — |
| Example 48 | 0.042 | 0.0010 | 0.017 | — | — | — | — | — | — |
| Example 49 | 0.041 | 0.0011 | 0.020 | — | — | — | — | — | — |
| Example 50 | 0.044 | 0.0015 | 0.022 | — | — | — | — | — | — |
| Example 51 | 0.046 | 0.0015 | 0.019 | — | — | — | — | — | — |
| Example 52 | 0.047 | 0.0010 | 0.023 | — | — | — | — | — | — |
| Example 53 | 0.034 | 0.0011 | 0.017 | — | — | — | — | — | — |
| Example 54 | 0.039 | 0.0010 | 0.047 | — | — | — | — | — | — |
| Example 55 | 0.037 | 0.0011 | 0.045 | — | — | — | — | — | — |
| Example 56 | 0.046 | 0.0011 | 0.046 | — | — | — | — | — | — |
| Example 57 | 0.041 | 0.0015 | 0.046 | — | — | — | — | — | — |
| Example 58 | 0.041 | 0.0015 | 0.048 | — | — | — | — | — | — |
| Example 59 | 0.038 | 0.0012 | 0.049 | — | — | — | — | — | — |
| Example 60 | 0.041 | 0.0011 | 0.040 | — | — | — | — | — | — |
| Example 61 | 0.036 | 0.0016 | 0.052 | — | — | — | — | — | — |
| Example 62 | 0.057 | 0.0010 | 0.054 | — | — | — | — | — | — |
| Example 63 | 0.034 | 0.0011 | 0.065 | — | — | — | — | — | — |
| Example 64 | 0.036 | 0.0013 | 0.064 | — | — | — | — | — | — |
| Example 65 | 0.033 | 0.0016 | 0.057 | — | — | — | — | — | — |
| Example 66 | 0.065 | 0.0012 | 0.053 | — | — | — | — | — | — |
| Example 67 | 0.046 | 0.0022 | 0.051 | — | — | — | — | — | — |
| Example 68 | 0.037 | 0.0016 | 0.001 | — | — | — | — | — | — |
| Example 69 | 0.041 | 0.0015 | 0.002 | — | — | — | — | — | — |
| Example 70 | 0.035 | 0.0016 | 0.046 | — | — | — | — | — | — |
| Example 71 | 0.039 | 0.0010 | 0.047 | — | — | — | — | — | — |
| Example 72 | 0.042 | 0.0012 | 0.048 | — | — | — | — | — | — |
| Example 73 | 0.040 | 0.0011 | 0.044 | — | — | — | — | — | — |
| Example 74 | 0.035 | 0.0011 | 0.062 | — | — | — | — | — | — |

TABLE 2

| | Heat Treatment | |
|---|---|---|
| | Heating Temperature (° C.) | Cooling Method |
| No. | | |
| Example 1 | 850 | Cooling in Furnace |
| Example 2 | 850 | Cooling in Furnace |
| Example 3 | 850 | Cooling in Furnace |
| Example 4 | 880 | Cooling in Furnace |
| Example 5 | 880 | Cooling in Furnace |
| Example 6 | 900 | Cooling in Furnace |
| Example 7 | 900 | Cooling in Furnace |
| Example 8 | 900 | Cooling in Furnace |
| Example 9 | — | — |
| Example 10 | 940 | Cooling in Furnace |
| Example 11 | 910 | Cooling in Furnace |
| Example 12 | 940 | Cooling in Furnace |
| Example 13 | 940 | Cooling in Furnace |
| Example 14 | 940 | Cooling in Furnace |
| Example 15 | 940 | Cooling in Furnace |
| Example 16 | 850 | Cooling in Furnace |
| Example 17 | 850 | Cooling in Furnace |
| Example 18 | 850 | Cooling in Furnace |
| Example 19 | 940 | Cooling in Furnace |
| Example 20 | 900 | Cooling in Furnace |
| Example 21 | 900 | Cooling in Furnace |
| Example 22 | 900 | Cooling in Furnace |
| Example 23 | 900 | Cooling in Furnace |
| Example 24 | 850 | Cooling in Furnace |
| Example 25 | 940 | Cooling in Furnace |
| Example 26 | 850 | Cooling in Furnace |
| Example 27 | 940 | Cooling in Furnace |
| Example 28 | 940 | Cooling in Furnace |
| Example 29 | 940 | Cooling in Furnace |
| Example 30 | 900 | Cooling in Furnace |
| Example 31 | 940 | Cooling in Furnace |
| Example 32 | 940 | Cooling in Furnace |
| Example 33 | 940 | Cooling in Furnace |
| Example 34 | 940 | Cooling in Furnace |
| Example 35 | 940 | Cooling in Furnace |
| Example 36 | 900 | Cooling in Furnace |
| Example 37 | 900 | Cooling in Furnace |
| Example 38 | 900 | Cooling in Furnace |
| Example 39 | 900 | Cooling in Furnace |
| No.(1) | | |
| Comp. Ex. 1 | — | — |
| Comp. Ex. 2 | 600 | Air-Cooled |
| Comp. Ex. 3 | 850 | Cooling in Furnace |
| Comp. Ex. 4 | 850 | Cooling in Furnace |
| Comp. Ex. 5 | 880 | Cooling in Furnace |
| Comp. Ex. 6 | 940 | Cooling in Furnace |
| Comp. Ex. 7 | 940 | Cooling in Furnace |
| Comp. Ex. 8 | 850 | Cooling in Furnace |
| Comp. Ex. 9 | — | — |
| Comp. Ex. 10 | 940 | Cooling in Furnace |
| Comp. Ex. 11 | 940 | Cooling in Furnace |
| Comp. Ex. 12 | 850 | Cooling in Furnace |
| Comp. Ex. 13 | 940 | Cooling in Furnace |
| Comp. Ex. 14 | 850 | Cooling in Furnace |
| Comp. Ex. 15 | 850 | Cooling in Furnace |
| Comp. Ex. 16 | 940 | Cooling in Furnace |
| Con. Ex. 1 | — | — |
| Con. Ex. 2 | — | — |
| Con. Ex. 3 | 940 | Cooling in Furnace |
| Con. Ex. 4 | — | — |
| Con. Ex. 5 | 910 | Air-Cooled |
| Con. Ex. 6 | 910 | Air-Cooled |
| No. | | |
| Example 40 | 900 | Cooling in Furnace |
| Example 41 | 900 | Cooling in Furnace |
| Example 42 | 900 | Cooling in Furnace |
| Example 43 | 900 | Cooling in Furnace |
| Example 44 | 900 | Cooling in Furnace |
| Example 45 | 900 | Cooling in Furnace |
| Example 46 | 900 | Cooling in Furnace |

TABLE 2-continued

| | Heat Treatment | |
|---|---|---|
| | Heating Temperature (° C.) | Cooling Method |
| Example 47 | 900 | Cooling in Furnace |
| Example 48 | 900 | Cooling in Furnace |
| Example 49 | 900 | Cooling in Furnace |
| Example 50 | 900 | Cooling in Furnace |
| Example 51 | 900 | Cooling in Furnace |
| Example 52 | 900 | Cooling in Furnace |
| Example 53 | 900 | Cooling in Furnace |
| Example 54 | 900 | Cooling in Furnace |
| Example 55 | 900 | Cooling in Furnace |
| Example 56 | 900 | Cooling in Furnace |
| Example 57 | 900 | Cooling in Furnace |
| Example 58 | 900 | Cooling in Furnace |
| Example 59 | 900 | Cooling in Furnace |
| Example 60 | 900 | Cooling in Furnace |
| Example 61 | 900 | Cooling in Furnace |
| Example 62 | 900 | Cooling in Furnace |
| Example 63 | 900 | Cooling in Furnace |
| Example 64 | 900 | Cooling in Furnace |
| Example 65 | 900 | Cooling in Furnace |
| Example 66 | 900 | Cooling in Furnace |
| Example 67 | 900 | Cooling in Furnace |
| Example 68 | 940 | Cooling in Furnace |
| Example 69 | 940 | Cooling in Furnace |
| Example 70 | 940 | Cooling in Furnace |
| Example 71 | 940 | Cooling in Furnace |
| Example 72 | 940 | Cooling in Furnace |
| Example 73 | 940 | Cooling in Furnace |
| Example 74 | 940 | Cooling in Furnace |

Note:
(1)"Comp. Ex." represents Comparative Example, and "Con. Ex." represents Conventional Example.

(1) Concentration Distributions of Elements in Intermediate Layers and Their Microstructures Using a field-emission, scanning electron microscope (FE-SEM) and an energy-dispersive X-ray spectrometer (FE-SEM EDS, "S-4000" available from Hitachi, Ltd.) attached thereto, and a field-emission transmission electron microscope (FE-TEM) and an energy-dispersive X-ray spectrometer (FE-TEM EDS, "HF-2100" available from Hitachi, Ltd.) attached thereto, each cast iron of Examples 1-74, Comparative Examples 1-16 and Conventional Examples 1-6 was observed as follows.

Each cast iron sample of 10 mm each was embedded in a resin of 30 mm in diameter, mirror-polished, and its microstructure was observed by an optical microscope (magnification: 400 times). Thereafter, the existence of intermediate layers in graphite-matrix boundaries was observed by FE-SEM (magnification: 10,000 times).

Further, a sample of 4 um in thickness, 10 μm in length and 15 μm in width was cut out of the intermediate layers and their nearby regions by a micro-sampling method using focused ion beams (FIB) of a focused-ion-beam milling system ("FB-2000A" available from Hitachi, Ltd.), and each sample was made thinner to 0.1 μm. Each of the resultant samples was observed substantially in graphite-matrix boundaries by FE-TEM, and element analysis was conducted using an energy-dispersive X-ray spectrometer (EDS).

Figure 3:
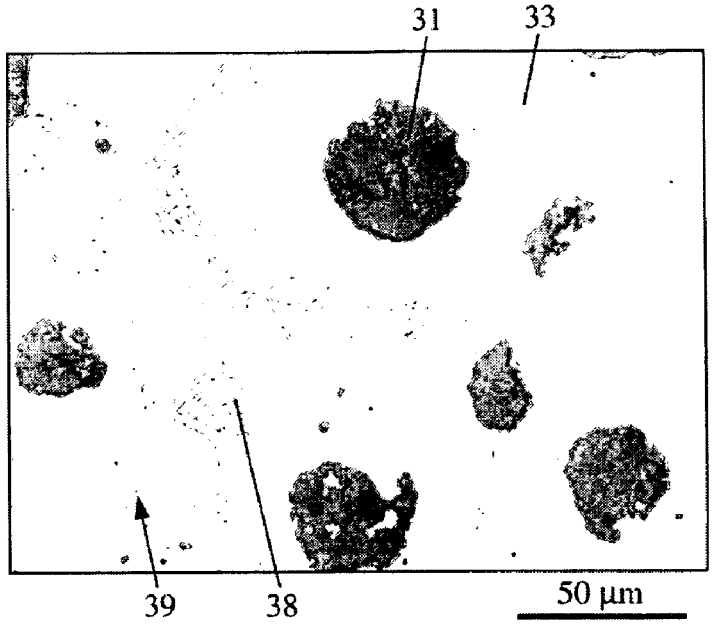
FIG. 3 is an optical photomicrograph showing the microstructure of the heat-resistant cast iron of Example 8.
Figure 4:
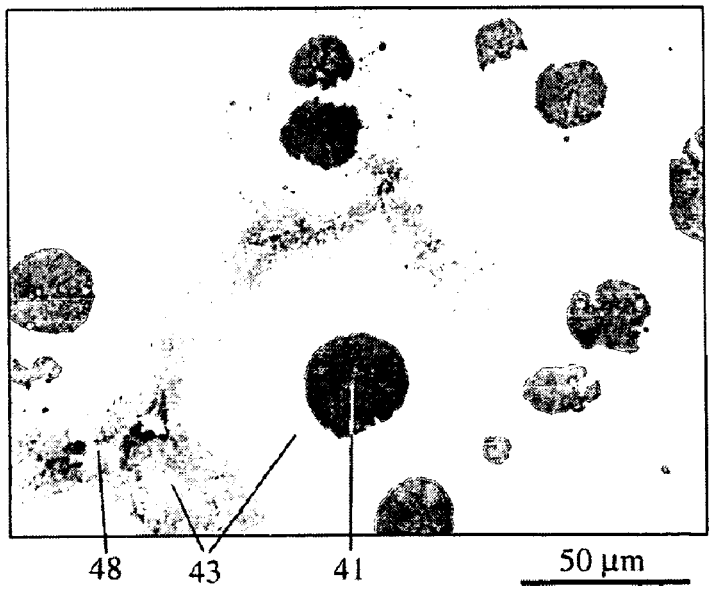
FIG. 4 is an optical photomicrograph showing the microstructure of the heat-resistant cast iron of Conventional Example 3.
Figure 5:
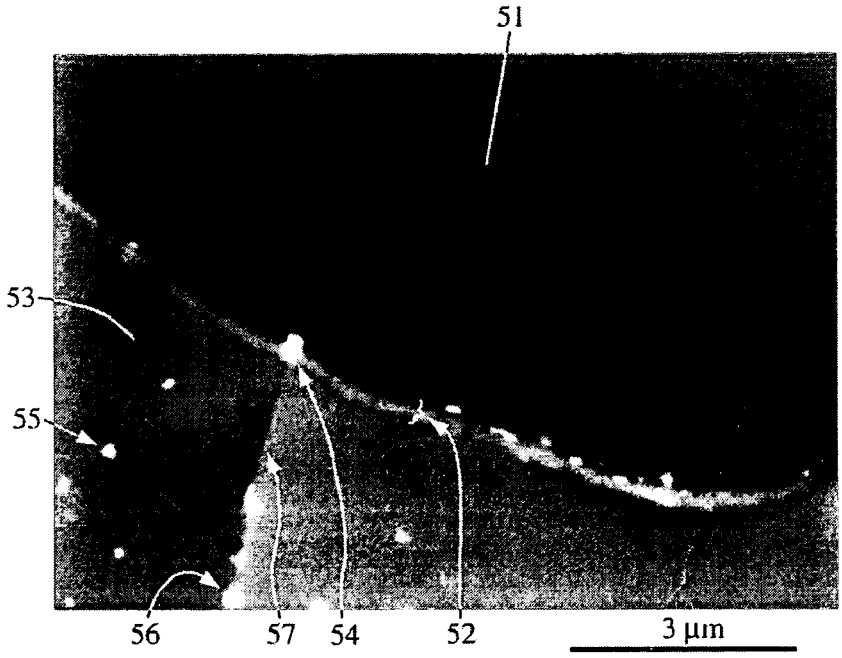
FIG. 5 is an FE-SEM photograph showing the microstructure of Example 8 substantially in a boundary of a graphite particle with a matrix.
Figure 6:
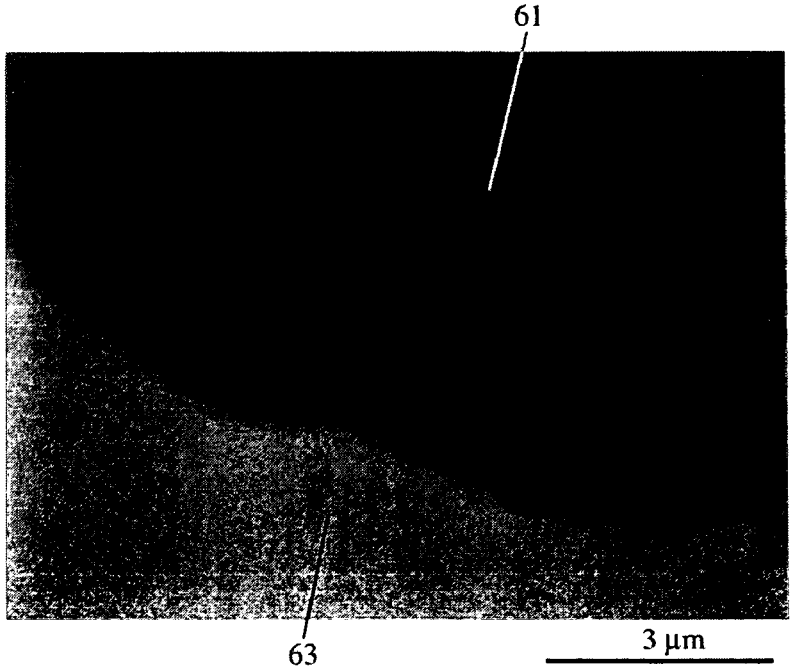
FIG. 6 is an FE-SEM photograph showing the microstructure of Conventional Example 3 substantially in a boundary of a graphite particle with a matrix.
Figure 7:
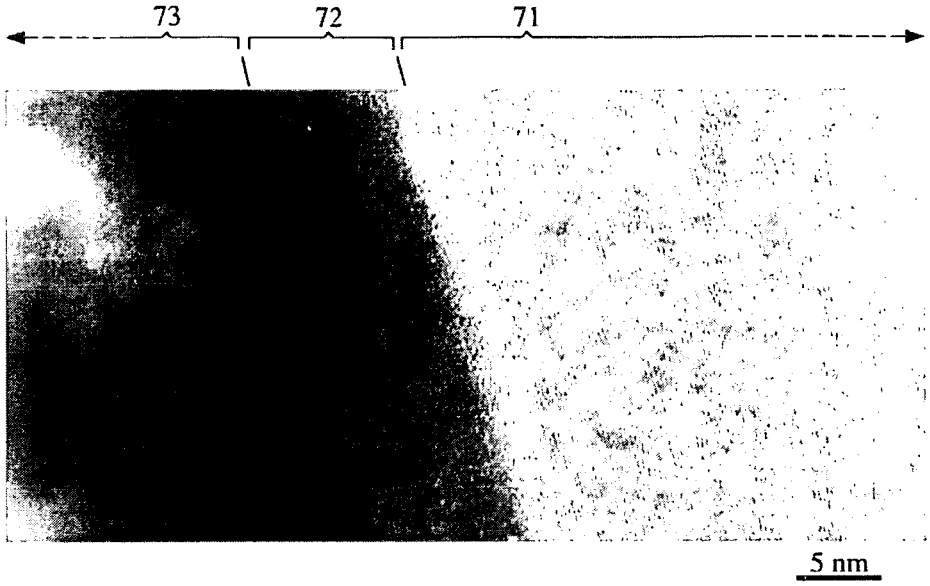
FIG. 7 is a high-resolution FE-TEM photograph showing the microstructure of Example 8 substantially in a boundary of a graphite particle with a matrix.

With respect to the samples of Example 8 and Conventional Example 3, the optical photomicrographs of their microstructures are shown in FIGS. 3 and 4, and the FE-SEM photographs of microstructures substantially in the graphite-matrix boundaries are shown in FIGS. 5 and 6. The high-resolution FE-TEM photograph (magnification: 2,000,000 times) of a microstructure substantially in the graphite-matrix boundary in Example 8 is shown in FIG. 7.

The optical photomicrographs of FIGS. 3 and 4 indicate that Example 8 differs from Conventional Example 3 in the morphology of eutectic carbide 38 existing in eutectic cell boundaries, because fine carbide particles 39 exist in a ferrite matrix 33 (grains), too. However, the observation by an optical microscope (magnification: 400 times) failed to discern the existence of intermediate layers and carbide particles in the boundaries of graphite particles 31 and the matrix 33. In FIG. 4, 41 denotes graphite particles, 43 denotes the matrix, in which a white area is a ferrite phase, and a black area is a pearlite phase, and 48 denotes eutectic carbide.

It was confirmed from FIG. 5, an FE-SEM photograph (10,000 times), that an intermediate layer 52 and W-containing carbide particles 54 were formed in the boundary of a graphite particle 51 and the matrix 53 in Example 8. The W-containing carbide particles were formed not only substantially in the boundary, but also in the matrix 53 (as indicated by 55), and in a boundary 57 in contact with the graphite particle 51 (as indicated by 56). A method for observing that the carbide contains W will be explained later. It was confirmed from FIG. 6, an FE-SEM photograph (magnification: 10,000 times), that there were not an intermediate layer and W-containing carbide particles in and substantially in the boundary of a graphite particle 61 and a matrix 63 in Conventional Example 3.

Figure 8:
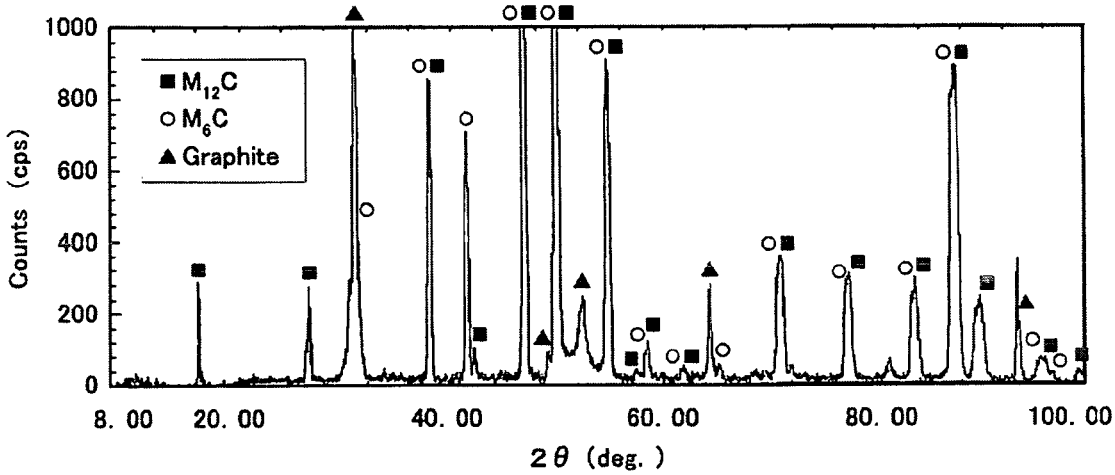
FIG. 8 is a graph showing the X-ray diffraction results in Example 8.

The crystal structure of carbide was observed in the sample of Example 8 as follows. A specimen of 20 mm each was cut out from the sample of Example 8, ground with an emery paper to remove an oxide layer from the surface, and subjected to a residue extraction method to extract graphite and carbide. The residue extraction method comprises chemically etching the sample with a 10-% solution of nitric acid in alcohol under ultrasonic vibration, and filtering out the residue. The resultant extracts were subjected to X-ray diffraction analysis (Co target, 50 kV, and 200 mA), using an X-ray diffraction apparatus ("RINT 1500" available from Rigaku Corp.). The results are shown in FIG. 8. It is clear from FIG. 8 that the sample of Example 8 contained $M_6C$ carbide (corresponding to 41-1351 in the ASTM card) and $M_{12}C$ carbide (corresponding to 23-1127 in the ASTM card) both containing W.

In FIG. 7, a high-resolution FE-TEM photograph (2,000,000 times) of the sample of Example 8, an intermediate layer 72 as thick as about 10 nm was observed. Because the intermediate layer 72 had a different crystal orientation from those of the adjacent graphite particle 71 and matrix 73, it is clear that the intermediate layer 72 had a phase different from those of the graphite particle 71 and the matrix 73. The observation of several intermediate layers 72 in the same sample revealed that the intermediate layers 72 were as wide as at most about 20 nm.

Figure 9:
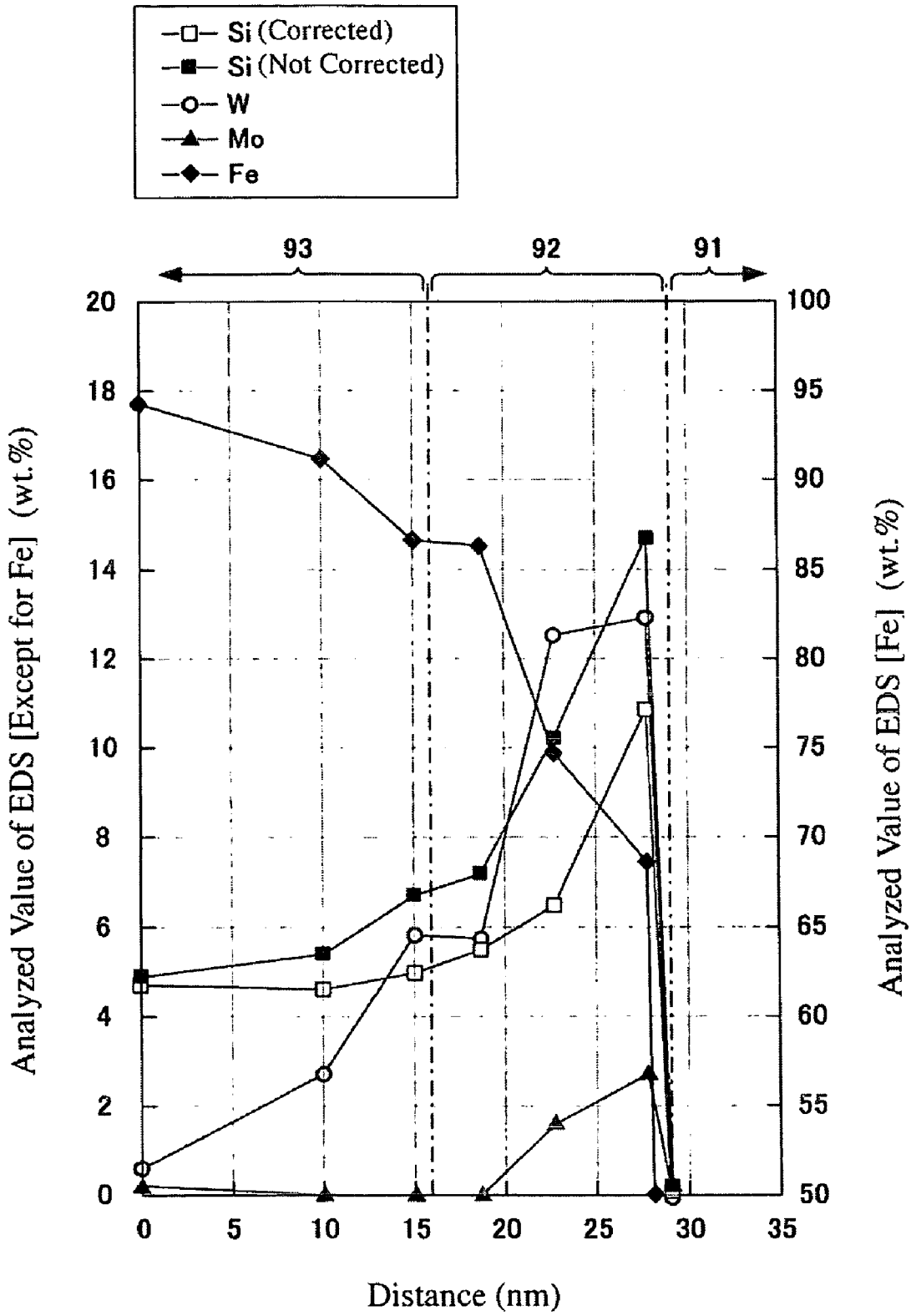
FIG. 9 is a graph showing the concentration distributions of Si, W, Mo and Fe substantially in a boundary of a graphite particle with a matrix in Example 8.
Figure 10:
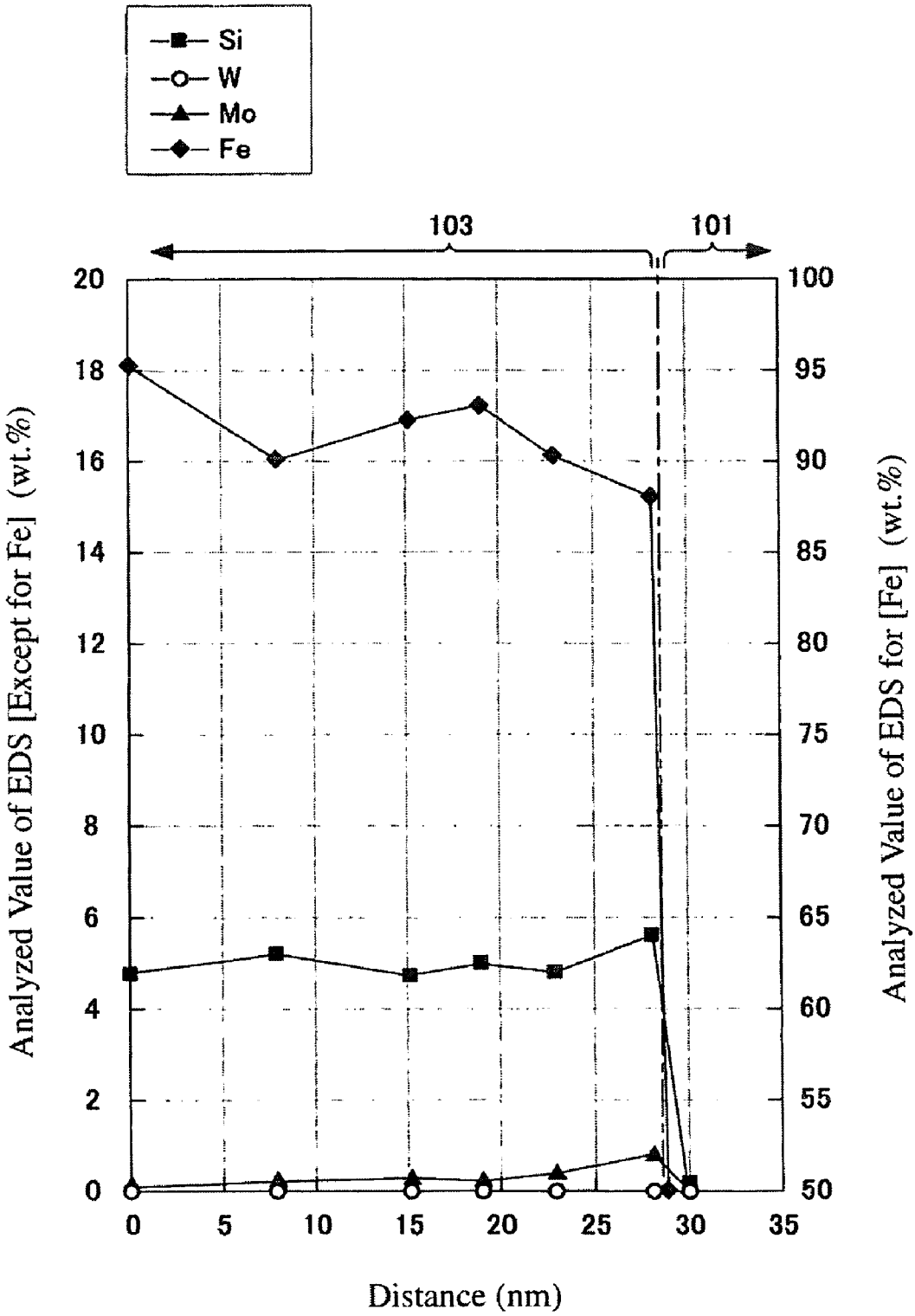
FIG. 10 is a graph showing the concentration distributions of Si, W, Mo and Fe substantially in a boundary of a graphite particle with a matrix in Conventional Example 3.

The concentration distributions of Si, W, Mo and Fe in the boundaries of graphite particles and the matrix were investigated by element analysis using FE-TEM-EDS. FIGS. 9 and 10 show the concentration distributions of Si, W, Mo and Fe in the samples of Example 8 and Conventional Example 3, respectively. The analyzed value of Si was obtained by peak separation method (Gaussian method). It is expected, however, that this peak separation method tends to provide a larger analyzed value of Si, because the Kα line of Si overlaps the Mα line of W. To correct the analyzed value of Si, analysis was conducted on WC-cemented carbide containing no Si, and peak separation was conducted assuming that Si was contained, resulting in an Si/W ratio [ratio of the analyzed value of Si to the analyzed value of W] of 0.3. Thus, the corrected Si value was determined by subtracting the analyzed value of W multiplied by 0.3 from the analyzed value of Si. In the present invention, the weight ratio Ym of Si in the matrix and the weight ratio Yi of Si in the intermediate layers were corrected, taking into consideration the overlap of the Kα line of Si and the Mα line of W in the peak separation method. Incidentally, the analyzed value of W was determined from an Lα line, needing no such peak separation.

Examples 1-74, Comparative Examples 1-16 and Conventional Examples 1-6 were measured with respect to a graphite shape, a spheroidization ratio, the thickness of intermediate layers, the concentrations of W and Si, Xi/Xm, and Yi/Ym. The graphite shape was "spheroidal" when the spheroidization ratio was 70% or more, and "compact vermicular" when it was less than 70%. The spheroidization ratio was measured by a method for determining a spheroidization ratio according to JIS G5502 10.7.4. Xi/Xm and Yi/Ym were measured in intermediate layers and a matrix at two arbitrary positions with respect to each of three graphite particles, and averaged. The results are shown in Table 3. The concentrations of W and Si were evaluated by the following standards.

Good: Intermediate layers were observed, with Xi/Xm or Yi/Ym in the preferred range, Fair: Intermediate layer were observed, with Xi/Xm or Yi/Ym outside the preferred range, and Poor: No intermediate layers were observed.

As is clear from FIG. 9, the concentration of W and Si gradually increased from a matrix 93 to graphite 91 in the sample of Example 8, with W and Si more concentrated in the intermediate layer 92 than in the matrix 93 and Fe decreased correspondingly. In the sample of Example 8, the ratio (Xi/Xm) of the weight ratio Xi of W in the intermediate layers to the weight ratio Xm of W in the matrix was 15.80 on average, and the ratio (Yi/Ym) of the weight ratio Yi of Si in the intermediate layers to the weight ratio Ym of Si in the matrix was 2.29 on average. In Conventional Example 3, as shown in FIG. 10, neither intermediate layers nor the concentration of Si and W were observed.

As is clear from Table 3, intermediate layers and the concentration of W and Si were observed in any of Examples 1-74. The Xi/Xm was 5 or more in Examples 1-74 except for Example 18, and the Yi/Ym was 1.5 or more in Examples 1-17 and 20-74. On the other hand, the intermediate layers had insufficient concentration of W and Si in any of Comparative Examples 1-5, with Xi/Xm of 3.85 or less and Yi/Ym of 1.38 or less. W was not sufficiently concentrated in the intermediate layers in Comparative Examples 6-9 (Xi/Xm: 3.07-4.98), although Si was sufficiently concentrated (Yi/Ym: 1.60-1.80). The later-described thermal cracking lives in Comparative Examples 10-13 were as short as less than 780 cycles because of the W content outside the range of the present invention, although W and Si were sufficiently concentrated in the intermediate layers. In Comparative Examples 14-16, the thermal cracking life was less than 780 cycles regardless of the concentration of W and Si in the intermediate layers, because the Si content was outside the range of the present invention.

The comparison of Examples 8 and 9 revealed that while the intermediate layers were as thin as 1-8 nm in Example 9 without heat treatment, they were as thick as 10-20 nm in Example 8 with heat treatment, confirming that the heat treatment made the intermediate layers thicker. This indicates that the heat treatment stabilizes the formation of intermediate layers.

In Comparative Examples 1-10, in which W was less than 1.2% by weight, the intermediate layers were mostly as thin as 0-10 nm, with some portions free from intermediate layers. In Examples 1-74, in which W was 1.2% or more by weight, the intermediate layers were mostly as thick as 5 nm or more.

This indicates that the inclusion of 1.2% or more by weight of W stably produces thick intermediate layers.

Each mirror-polished sample of Examples 1-74, Comparative Examples 1-16 and Conventional Examples 1-6 was etched with a 10-% Nital etching solution for about 1-5 minutes in an ultrasonic washing apparatus, washed with 10-% hydrochloric acid to remove etching products, and then washed with an organic solvent. This treatment predominantly etched the matrix, causing carbide particles to three-dimensionally appear on the graphite surface. Because the number of W-containing carbide particles on the graphite surface appears to be proportional to the number of W-containing carbide particles in the boundaries of graphite particles and the matrix, the number of W-containing carbide particles on the graphite particles exposed by etching was used as a parameter expressing the number of carbide particles in the boundaries of graphite particles and the matrix. The area ratio of W-containing carbide particles was determined on W-containing carbide particles on the graphite particles exposed by etching.

In the sample of Example 8, carbide particles in the boundaries of graphite particles and the matrix were observed by FE-SEM. EDS (10,000 times) for analyzing the components of carbide on the graphite surface detected 64.7% by weight of W, 10.0% by weight of Mo, 23.6% by weight of Fe, and 1.7% by weight of C. This result revealed that W was contained in carbide particles in the boundaries of graphite particles and the matrix (carbide on the graphite surface). It is clear from FIG. 11(*a*), an FE-SEM photograph of the sample of Example 8, that a lot of W-containing carbide particles 114 were formed on the graphite 111.

The total number Nc of graphite particles and the number Ncw of graphite particles having W-containing carbide particles were counted in three arbitrary fields of the FE-SEM photograph corresponding to a 1-$mm^2$ area of the sample, and the percentage (Ncw/Nc) of the number of graphite particles having W-containing carbide particles to the total number of graphite particles was calculated. Whether or not the W-containing carbide particles existed in the boundaries of graphite particles and the matrix was determined by the observation of graphite particles at a magnification of 10,000 times or more and EDS. In Example 8, all graphite particles had W-containing carbide particles on the surface in the observed fields, so that Ncw/Nc was 100%.

Figure 12:
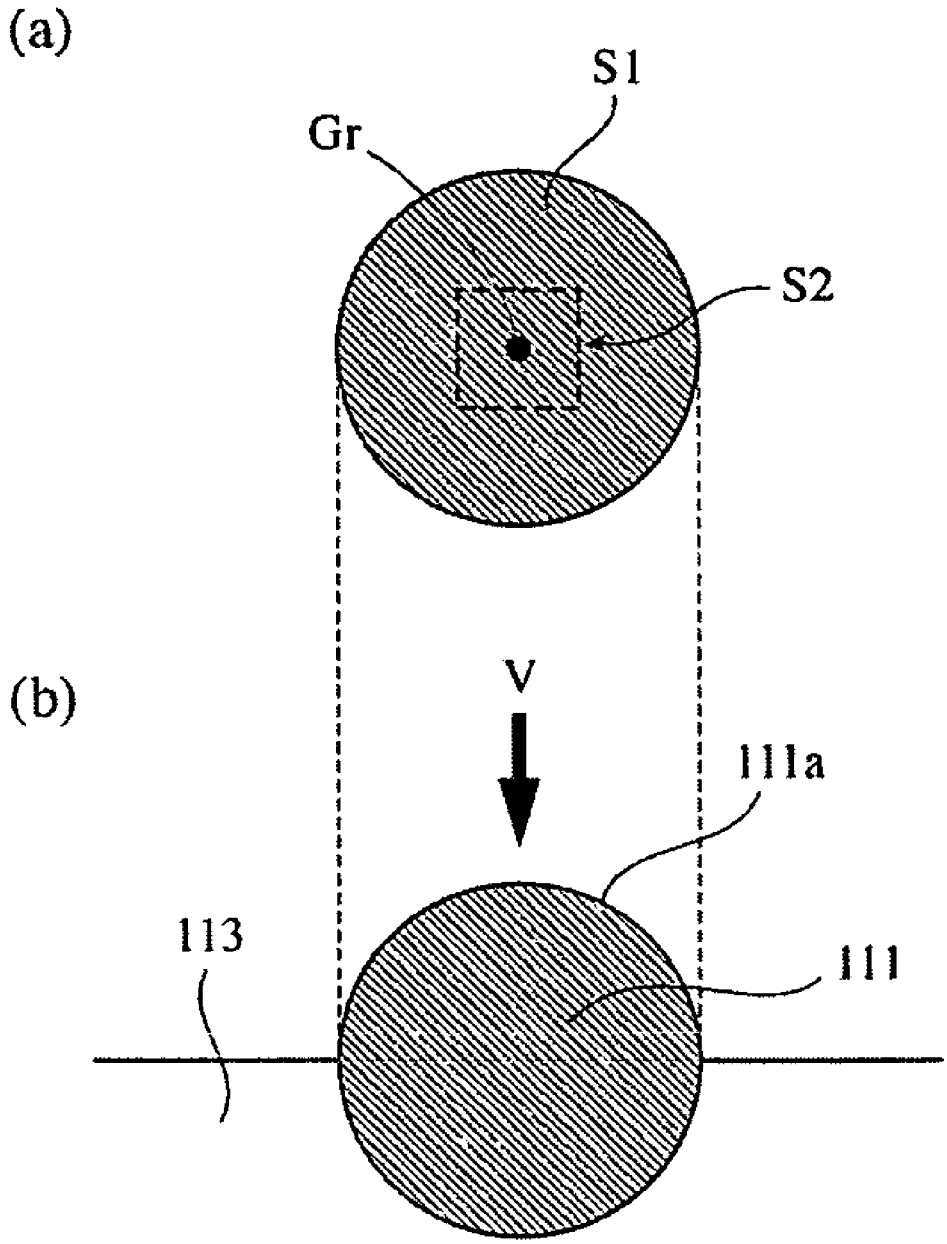
FIGS. 12(*a*) and 12(*b*) are a schematic plan view and a schematic cross-sectional view showing a method for determining the number and area ratio of W-containing carbide particles per a unit area of graphite.

The calculation of the number and area ratio of W-containing carbide particles on the graphite surface was conducted as follows. As schematically shown in FIGS. 12(*a*) and (*b*), a surface 111*a* of a graphite particle 111 exposed by the above etching treatment was photographed by FE-SEM perpendicularly to the sample surface, to obtain a two-dimensional, projected image SI of the graphite surface 111*a* [FIG. 12(*a*)]. A portion corresponding to 10-15% of the projected area in a region including a center of gravity Gr (substantially center) in the projected, two-dimensional image S1 was extracted as a carbide-measuring region S2, and photographed by FE-SEM. The contours of W-containing carbide particles were traced from the FE-SEM photograph on a tracing paper, and the number and area of W-containing carbide particles were measured by an image analyzer ("IP1000" available from Asahi Kasei Corporation). The resultant measured values were divided by the area of the carbide-measuring region S2 to obtain the number and area ratio of W-containing carbide particles per unit area. The above measurement was conducted on 15 graphite particles arbitrarily selected from those having W-containing carbide particles, and their measured values were averaged.

10-15% of the projected area of the graphite particle was extracted as the carbide-measuring region S2, because less than 10% was too small a measurement region to the entire projected area of the graphite particle, failing to grasp the true structure, and because more than 15% causes carbide particles particularly on a periphery of the graphite particle to look two-dimensionally overlapped due to the curvature of the graphite particle, failing to discern them.

Figure 11A:
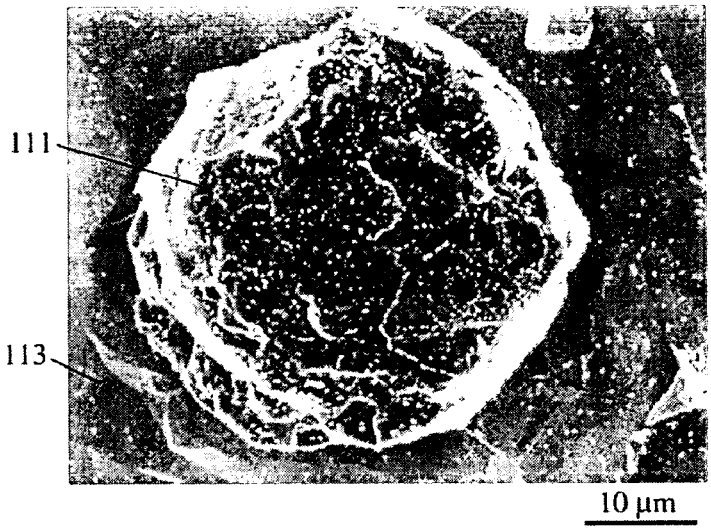
FIG. 11(*a*) is an FE-SEM photograph showing the heat-resistant cast iron of Example 8, on which graphite, carbide, etc. are exposed.
Figure 11B:
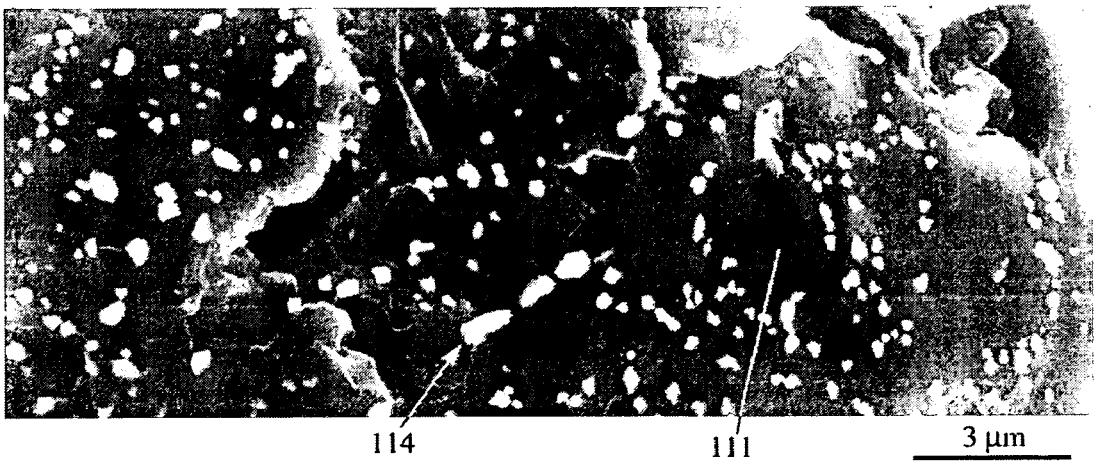

FIG. 11(*b*) is an enlarged photograph of the carbide-measuring region S2 (13% of the projected area of the graphite). Granular W-containing carbide particles 114 looked white on the surface of the graphite 111. In the sample of Example 8, the number and area ratio of W-containing carbide particles were $7.84\times10^5/mm^2$ and 6.7%, respectively, per a unit area of graphite, as averaged values of 15 graphite particles having W-containing carbide particles. The average size of the W-containing carbide particles 114 was 0.34 μm.

Thus, the percentage of graphite particles having W-containing carbide particles on the surface, the number of W-containing carbide particles ($/mm^2$) per a unit area of graphite, and the area ratio of W-containing carbide particles on the graphite surface were determined. The results are shown in Table 4.

As is clear from Table 4, the number of graphite particles having W-containing carbide particles on the surface was 61% or more of the total number of graphite particles in any of Examples 1-74. Particularly in Examples 2-19 and 24-74, the number of graphite particles having W-containing carbide particles on the surface was 75% or more of the total number of graphite particles. In Comparative Examples 1-6, 9 and 14, the number of graphite particles having W-containing carbide particles on the surface was less than 75% of the total number of graphite particles. The number of W-containing carbide particles per a unit area of graphite was $3\times10^5/mm^2$ or more in Examples 1-35 and 40-74, while it was less than $3\times10^5/mm^2$ in Comparative Examples 1-10. Further, the area ratio of W-containing carbide particles on the graphite surface was mostly 1.8% or more in Examples 1-74, while it was less than 1.8% in Comparative Examples 1-10. In Conventional Examples 1-6, no W-containing carbide particles were observed on the graphite surface.

The comparison of Examples 8 and 9 revealed that although 100% of graphite particles had W-containing carbide particles substantially in their boundaries with the matrix in both Examples, the number and area ratio of W-containing carbide particles per a unit area of graphite were larger in Example 8 with heat treatment than Example 9 without heat treatment. This indicates that the heat treatment stably forms W-containing carbide particles substantially in boundaries of graphite particles and the matrix.

TABLE 3

| No. | Graphite Shape[1] | Spheroidization Ratio (%) | Thickness of Intermediate Layer (nm) | Concentration W | Concentration Si | Xi/Xm | Yi/Ym |
|---|---|---|---|---|---|---|---|
| Example 1 | SP | 80 | 5-10 | Good | Good | 6.9 | 2.9 |
| Example 2 | SP | 81 | 5-15 | Good | Good | 7.4 | 3.2 |
| Example 3 | SP | 82 | 8-15 | Good | Good | 9.7 | 3.4 |
| Example 4 | SP | 83 | 5-15 | Good | Good | 8.3 | 3.1 |
| Example 5 | SP | 81 | 5-15 | Good | Good | 10.8 | 3.6 |
| Example 6 | SP | 80 | 5-15 | Good | Good | 10.0 | 3.4 |
| Example 7 | SP | 84 | 8-15 | Good | Good | 12.1 | 3.8 |
| Example 8 | SP | 86 | 10-20 | Good | Good | 15.80 | 2.29 |
| Example 9 | SP | 84 | 1-8 | Good | Good | 15.20 | 2.20 |
| Example 10 | SP | 81 | 10-20 | Good | Good | 14.88 | 2.00 |
| Example 11 | SP | 71 | 10-25 | Good | Good | 16.70 | 2.50 |
| Example 12 | SP | 75 | 10-25 | Good | Good | 17.10 | 2.40 |
| Example 13 | CV | 65 | 10-30 | Good | Good | 18.80 | 2.50 |
| Example 14 | CV | 55 | 10-35 | Good | Good | 17.80 | 2.50 |
| Example 15 | SP | 88 | 5-10 | Good | Good | 5.80 | 2.30 |
| Example 16 | SP | 87 | 5-10 | Good | Good | 6.76 | 2.03 |
| Example 17 | SP | 85 | 1-5 | Good | Good | 5.20 | 1.76 |
| Example 18 | SP | 78 | 0-3 | Fair | Fair | 4.72 | 1.08 |
| Example 19 | CV | 57 | 0-5 | Good | Fair | 12.87 | 1.31 |
| Example 20 | SP | 82 | 5-15 | Good | Good | 6.92 | 2.56 |
| Example 21 | SP | 85 | 5-15 | Good | Good | 6.81 | 2.42 |
| Example 22 | SP | 83 | 5-10 | Good | Good | 6.62 | 1.88 |
| Example 23 | SP | 80 | 1-5 | Good | Good | 5.08 | 1.65 |
| Example 24 | SP | 80 | 5-15 | Good | Good | 11.80 | 1.56 |
| Example 25 | SP | 82 | 5-10 | Good | Good | 6.12 | 2.10 |
| Example 26 | CV | 38 | 10-20 | Good | Good | 14.60 | 2.28 |
| Example 27 | SP | 89 | 5-10 | Good | Good | 14.70 | 2.20 |
| Example 28 | SP | 87 | 5-15 | Good | Good | 16.10 | 2.21 |
| Example 29 | SP | 87 | 5-15 | Good | Good | 15.50 | 2.00 |
| Example 30 | SP | 82 | 10-20 | Good | Good | 14.60 | 2.30 |
| Example 31 | SP | 83 | 10-20 | Good | Good | 13.20 | 2.50 |
| Example 32 | SP | 85 | 10-20 | Good | Good | 13.30 | 2.40 |
| Example 33 | SP | 85 | 10-20 | Good | Good | 14.30 | 2.20 |
| Example 34 | SP | 85 | 10-20 | Good | Good | 16.20 | 2.50 |
| Example 35 | SP | 88 | 10-20 | Good | Good | 15.40 | 2.60 |
| Example 36 | SP | 90 | 5-15 | Good | Good | 5.01 | 2.20 |
| Example 37 | SP | 84 | 5-10 | Good | Good | 6.33 | 2.10 |
| Example 38 | SP | 87 | 5-10 | Good | Good | 5.21 | 1.80 |
| Example 39 | SP | 87 | 5-10 | Good | Good | 6.03 | 1.70 |

Note:
[1]SP represents "spheroidal," and CV represents "compact vermicular."

| No.[1] | Graphite Shape[2] | Spheroidization Ratio (%) | Thickness of Intermediate Layer (nm) | Concentration W | Concentration Si | Xi/Xm | Yi/Ym |
|---|---|---|---|---|---|---|---|
| Comp. Ex. 1 | SP | 92 | 0-3 | Fair | Fair | 1.01 | 1.01 |
| Comp. Ex. 2 | SP | 89 | 0-5 | Fair | Fair | 1.11 | 1.09 |
| Comp. Ex. 3 | SP | 96 | 0-8 | Fair | Fair | 2.54 | 1.14 |
| Comp. Ex. 4 | SP | 84 | 0-8 | Fair | Fair | 2.70 | 1.21 |
| Comp. Ex. 5 | SP | 88 | 0-8 | Fair | Fair | 3.85 | 1.38 |
| Comp. Ex. 6 | SP | 87 | 0-8 | Fair | Good | 3.07 | 1.64 |
| Comp. Ex. 7 | SP | 84 | 0-10 | Fair | Good | 4.55 | 1.60 |
| Comp. Ex. 8 | SP | 85 | 1-10 | Fair | Good | 4.98 | 1.80 |
| Comp. Ex. 9 | SP | 88 | 0-5 | Fair | Good | 4.69 | 1.70 |
| Comp. Ex. 10 | SP | 86 | 1-10 | Good | Good | 5.21 | 2.50 |
| Comp. Ex. 11 | CV | 52 | 12-40 | Good | Good | 16.40 | 2.50 |
| Comp. Ex. 12 | CV | 51 | 8-25 | Good | Good | 18.63 | 1.95 |
| Comp. Ex. 13 | CV | 48 | 10-35 | Good | Good | 17.34 | 3.21 |
| Comp. Ex. 14 | SP | 81 | 0-5 | Fair | Fair | 2.04 | 1.26 |
| Comp. Ex. 15 | CV | 60 | 0-8 | Good | Fair | 13.72 | 1.28 |
| Comp. Ex. 16 | SP | 80 | 5-15 | Good | Good | 6.76 | 2.91 |
| Con. Ex. 1 | SP | 94 | 0 | Poor | Poor | — | — |
| Con. Ex. 2 | SP | 90 | 0 | Poor | Poor | — | — |
| Con. Ex. 3 | SP | 89 | 0 | Poor | Poor | — | — |
| Con. Ex. 4 | SP | 88 | 0 | Poor | Poor | — | — |
| Con. Ex. 5 | SP | 84 | 0 | Poor | Poor | — | — |
| Con. Ex. 6 | SP | 88 | 0 | Poor | Poor | — | — |

Note:
[1]"Comp. Ex." represents Comparative Example, and "Con. Ex." represents Conventional Example.
[2]SP represents "spheroidal," and CV represents "compact vermicular."

TABLE 3-continued

| No. | Graphite Shape[1] | Spheroidization Ratio (%) | Thickness of Intermediate Layer (nm) | Concentration W | Concentration Si | Xi/Xm | Yi/Ym |
|---|---|---|---|---|---|---|---|
| Example 40 | CV | 41 | 5-20 | Good | Good | 13.2 | 4.0 |
| Example 41 | CV | 58 | 5-20 | Good | Good | 14.1 | 4.1 |
| Example 42 | SP | 72 | 5-20 | Good | Good | 13.5 | 4.2 |
| Example 43 | SP | 91 | 5-20 | Good | Good | 12.3 | 4.3 |
| Example 44 | SP | 95 | 5-20 | Good | Good | 13.6 | 4.2 |
| Example 45 | SP | 88 | 5-20 | Good | Good | 13.4 | 4.1 |
| Example 46 | CV | 38 | 5-20 | Good | Good | 14.7 | 4.0 |
| Example 47 | CV | 34 | 5-20 | Good | Good | 13.0 | 4.1 |
| Example 48 | CV | 48 | 5-20 | Good | Good | 12.7 | 4.4 |
| Example 49 | CV | 62 | 5-20 | Good | Good | 15.5 | 4.2 |
| Example 50 | SP | 83 | 5-20 | Good | Good | 14.0 | 4.3 |
| Example 51 | SP | 86 | 5-20 | Good | Good | 13.0 | 3.8 |
| Example 52 | SP | 80 | 5-20 | Good | Good | 14.5 | 4.2 |
| Example 53 | CV | 35 | 5-20 | Good | Good | 14.1 | 4.2 |
| Example 54 | CV | 31 | 5-20 | Good | Good | 13.8 | 4.1 |
| Example 55 | CV | 36 | 5-20 | Good | Good | 14.6 | 4.2 |
| Example 56 | CV | 45 | 5-20 | Good | Good | 13.6 | 4.0 |
| Example 57 | CV | 63 | 5-20 | Good | Good | 15.0 | 4.2 |
| Example 58 | SP | 71 | 5-20 | Good | Good | 13.8 | 3.9 |
| Example 59 | CV | 64 | 5-20 | Good | Good | 15.2 | 4.2 |
| Example 60 | CV | 32 | 5-20 | Good | Good | 16.0 | 4.1 |
| Example 61 | CV | 22 | 5-20 | Good | Good | 14.4 | 4.0 |
| Example 62 | CV | 24 | 5-20 | Good | Good | 13.8 | 4.1 |
| Example 63 | CV | 25 | 5-20 | Good | Good | 14.3 | 4.2 |
| Example 64 | CV | 27 | 5-20 | Good | Good | 13.6 | 4.0 |
| Example 65 | CV | 28 | 5-20 | Good | Good | 13.5 | 3.9 |
| Example 66 | CV | 26 | 5-20 | Good | Good | 14.0 | 3.8 |
| Example 67 | CV | 20 | 5-20 | Good | Good | 14.9 | 4.2 |
| Example 68 | SP | 81 | 10-35 | Good | Good | 16.7 | 4.4 |
| Example 69 | SP | 82 | 10-35 | Good | Good | 16.0 | 4.4 |
| Example 70 | CV | 31 | 10-30 | Good | Good | 15.9 | 4.0 |
| Example 71 | CV | 42 | 10-35 | Good | Good | 16.3 | 4.3 |
| Example 72 | CV | 44 | 10-35 | Good | Good | 16.8 | 4.2 |
| Example 73 | CV | 32 | 10-30 | Good | Good | 16.0 | 4.1 |
| Example 74 | CV | 25 | 10-35 | Good | Good | 16.4 | 4.3 |

Note:
[1]SP represents "spheroidal," and CV represents "compact vermicular."

TABLE 4

| No. | Percentage of Graphite Particles Having W-Containing Carbide on Surface (%)[1] | Number of W-Containing Carbide Particles on Graphite Surface (/mm$^2$) | Area Ratio of W-Containing Carbide Particles on Graphite Surface (%) |
|---|---|---|---|
| Example 1 | 66 | $4.75 \times 10^5$ | 2.10 |
| Example 2 | 100 | $5.17 \times 10^5$ | 2.63 |
| Example 3 | 100 | $6.08 \times 10^5$ | 4.10 |
| Example 4 | 100 | $5.22 \times 10^5$ | 2.7 |
| Example 5 | 100 | $6.35 \times 10^5$ | 3.9 |
| Example 6 | 100 | $5.33 \times 10^5$ | 2.34 |
| Example 7 | 100 | $6.40 \times 10^5$ | 4.22 |
| Example 8 | 100 | $7.84 \times 10^5$ | 6.7 |
| Example 9 | 100 | $3.46 \times 10^5$ | 3.26 |
| Example 10 | 100 | $6.74 \times 10^5$ | 5.6 |
| Example 11 | 100 | $6.27 \times 10^5$ | 7.1 |
| Example 12 | 100 | $6.01 \times 10^5$ | 7.6 |
| Example 13 | 100 | $5.78 \times 10^5$ | 15.7 |
| Example 14 | 100 | $5.47 \times 10^5$ | 16.4 |
| Example 15 | 75 | $3.51 \times 10^5$ | 1.23 |
| Example 16 | 78 | $4.35 \times 10^5$ | 2.2 |
| Example 17 | 80 | $4.22 \times 10^5$ | 1.8 |
| Example 18 | 80 | $4.29 \times 10^5$ | 2.2 |
| Example 19 | 100 | $5.71 \times 10^5$ | 16.4 |
| Example 20 | 71 | $4.16 \times 10^5$ | 2.1 |
| Example 21 | 65 | $3.54 \times 10^5$ | 2.3 |
| Example 22 | 68 | $3.89 \times 10^5$ | 1.7 |
| Example 23 | 61 | $3.23 \times 10^5$ | 1.4 |
| Example 24 | 100 | $4.99 \times 10^5$ | 1.8 |
| Example 25 | 75 | $3.45 \times 10^5$ | 1.22 |
| Example 26 | 100 | $6.99 \times 10^5$ | 5.78 |

TABLE 4-continued

| | | | |
|---|---|---|---|
| Example 27 | 100 | $8.46 \times 10^5$ | 4.3 |
| Example 28 | 100 | $6.82 \times 10^5$ | 7.4 |
| Example 29 | 100 | $6.74 \times 10^5$ | 7.6 |
| Example 30 | 100 | $8.75 \times 10^5$ | 4.6 |
| Example 31 | 100 | $7.55 \times 10^5$ | 10.1 |
| Example 32 | 100 | $4.59 \times 10^5$ | 4.6 |
| Example 33 | 100 | $4.87 \times 10^5$ | 4.1 |
| Example 34 | 100 | $7.12 \times 10^5$ | 5.8 |
| Example 35 | 100 | $7.74 \times 10^5$ | 7.4 |
| Example 36 | 100 | $2.33 \times 10^5$ | 1.2 |
| Example 37 | 100 | $2.55 \times 10^5$ | 1.1 |
| Example 38 | 100 | $2.14 \times 10^5$ | 1.3 |
| Example 39 | 100 | $2.22 \times 10^5$ | 1.2 |

Note:
(1)A ratio (%) of the number of graphite particles having W-containing carbide particles on the surface to the total number of graphite particles.

| No.(1) | Percentage of Graphite Particles Having W-Containing Carbide on Surface (%)(2) | Number of W-Containing Carbide Particles on Graphite Surface (/mm$^2$) | Area Ratio of W-Containing Carbide Particles on Graphite Surface (%) |
|---|---|---|---|
| Comp. Ex. 1 | 2 | $3.65 \times 10^3$ | 0.20 |
| Comp. Ex. 2 | 5 | $9.56 \times 10^3$ | 0.36 |
| Comp. Ex. 3 | 10 | $1.10 \times 10^4$ | 0.8 |
| Comp. Ex. 4 | 16 | $5.20 \times 10^4$ | 0.9 |
| Comp. Ex. 5 | 70 | $2.92 \times 10^5$ | 0.9 |
| Comp. Ex. 6 | 68 | $1.67 \times 10^5$ | 0.8 |
| Comp. Ex. 7 | 100 | $2.89 \times 10^5$ | 1.0 |
| Comp. Ex. 8 | 75 | $2.83 \times 10^5$ | 1.2 |
| Comp. Ex. 9 | 67 | $2.15 \times 10^5$ | 1.0 |
| Comp. Ex. 10 | 100 | $2.25 \times 10^5$ | 1.3 |
| Comp. Ex. 11 | 100 | $5.58 \times 10^5$ | 16.8 |
| Comp. Ex. 12 | 100 | $5.26 \times 10^5$ | 18.4 |
| Comp. Ex. 13 | 100 | $5.31 \times 10^5$ | 17.2 |
| Comp. Ex. 14 | 72 | $3.37 \times 10^5$ | 1.1 |
| Comp. Ex. 15 | 100 | $5.60 \times 10^5$ | 16.2 |
| Comp. Ex. 16 | 75 | $4.13 \times 10^5$ | 2.2 |
| Con. Ex. 1 | 0 | 0.00 | 0 |
| Con. Ex. 2 | 0 | 0.00 | 0 |
| Con. Ex. 3 | 0 | 0.00 | 0 |
| Con. Ex. 4 | 0 | 0.00 | 0 |
| Con. Ex. 5 | 0 | 0.00 | 0 |
| Con. Ex. 6 | 0 | 0.00 | 0 |

Note:
(1)"Comp. Ex." represents Comparative Example, and "Con. Ex." represents Conventional Example.
(2)A ratio (%) of the number of graphite particles having W-containing carbide particles on the surface to the total number of graphite particles.

| No. | Percentage of Graphite Particles Having W-Containing Carbide on Surface (%)(1) | Number of W-Containing Carbide Particles on Graphite Surface (/mm$^2$) | Area Ratio of W-Containing Carbide Particles on Graphite Surface (%) |
|---|---|---|---|
| Example 40 | 100 | $7.01 \times 10^5$ | 5.06 |
| Example 41 | 100 | $6.92 \times 10^5$ | 5.07 |
| Example 42 | 100 | $7.13 \times 10^5$ | 5.32 |
| Example 43 | 100 | $7.15 \times 10^5$ | 5.33 |
| Example 44 | 100 | $6.83 \times 10^5$ | 5.12 |
| Example 45 | 100 | $7.00 \times 10^5$ | 5.00 |
| Example 46 | 100 | $6.34 \times 10^5$ | 4.99 |
| Example 47 | 100 | $6.99 \times 10^5$ | 5.01 |
| Example 48 | 100 | $6.84 \times 10^5$ | 5.24 |
| Example 49 | 100 | $7.12 \times 10^5$ | 5.32 |
| Example 50 | 100 | $6.75 \times 10^5$ | 5.66 |
| Example 51 | 100 | $6.88 \times 10^5$ | 4.35 |
| Example 52 | 100 | $7.15 \times 10^5$ | 5.44 |
| Example 53 | 100 | $7.12 \times 10^5$ | 5.40 |
| Example 54 | 100 | $6.90 \times 10^5$ | 5.00 |
| Example 55 | 100 | $7.12 \times 10^5$ | 5.66 |
| Example 56 | 100 | $6.87 \times 10^5$ | 5.06 |
| Example 57 | 100 | $7.00 \times 10^5$ | 5.05 |
| Example 58 | 100 | $6.33 \times 10^5$ | 4.70 |
| Example 59 | 100 | $6.75 \times 10^5$ | 5.20 |
| Example 60 | 100 | $7.03 \times 10^5$ | 5.24 |
| Example 61 | 100 | $6.95 \times 10^5$ | 4.78 |
| Example 62 | 100 | $7.01 \times 10^5$ | 4.99 |

TABLE 4-continued

| | | | |
|---|---|---|---|
| Example 63 | 100 | $7.03 \times 10^5$ | 5.20 |
| Example 64 | 100 | $6.87 \times 10^5$ | 4.88 |
| Example 65 | 100 | $7.04 \times 10^5$ | 4.67 |
| Example 66 | 100 | $6.46 \times 10^5$ | 4.99 |
| Example 67 | 100 | $7.00 \times 10^5$ | 5.08 |
| Example 68 | 100 | $5.75 \times 10^5$ | 17.70 |
| Example 69 | 100 | $5.62 \times 10^5$ | 16.7 |
| Example 70 | 100 | $6.12 \times 10^5$ | 14.58 |
| Example 71 | 100 | $5.41 \times 10^5$ | 13.50 |
| Example 72 | 100 | $5.64 \times 10^5$ | 16.7 |
| Example 73 | 100 | $5.72 \times 10^5$ | 16.80 |
| Example 74 | 100 | $5.66 \times 10^5$ | 16.44 |

Note:
(1)A ratio (%) of the number of graphite particles having W-containing carbide particles on the surface to the total number of graphite particles.

(2) Oxidation Resistance (Weight Loss by Oxidation)

Each round-rod test piece (diameter: 10 mm, length: 20 mm) of Examples 1-74, Comparative Examples 1-16 and Conventional Examples 1-6 was subjected to the following two oxidation tests. In both tests, the weight $W_0$ of the test piece before oxidation, and the weight $W_1$ of the test piece subjected to shot blasting with glass beads after oxidation to remove oxide scale were measured, and its weight loss by oxidation per a unit area (mg/cm$^2$) was determined from ($W_0$-$W_1$).

(a) Oxidation Resistance Test at Constant Temperature

Each round-rod test piece was kept at a constant temperature of 800° C. for 200 hours to measure weight loss by oxidation. The results are shown in Table 5. As is clear from Table 5, the weight loss by oxidation tended to decrease as the W content increased from 1.26% by weight to 14.7% by weight, in Examples 1-14, in which the amounts of other components than W were substantially the same. This indicates that 1.2-15% by weight of W provides the heat-resistant cast iron with high oxidation resistance. The W content is preferably 1.5-10% by weight, more preferably 2-5% by weight.

The comparison of Examples 1 and 18 having substantially the same Si and W contents and different Ni contents revealed that the weight loss by oxidation was more in Example 18 in which the Ni content exceeded 0.5% by weight than in Example 1 containing no Ni. Example 16, in which the Ni content was 0.29% by weight, exhibited weight loss by oxidation of 75 mg/cm$^2$, slightly poorer oxidation resistance than that of Example 1 containing no Ni, but this is within a range free from problems. Accordingly, Ni is preferably less than 0.5% by weight, more preferably 0.3% or less by weight.

The comparison of Examples 40-60 and Examples 61-67 having substantially the same Si and W contents and different rare earth element contents revealed that Examples 61-67, in which the rare earth elements exceeded 0.05% by weight, exhibited as low spheroidization ratios as 20-28% with slightly large weight loss by oxidation of 71 mg/cm$^2$ or less at any S content level. On the contrary, Examples 42-45, 49-52 and 56-59, in which the rare earth elements were 0.05% or less by weight, and S was 0.003-0.02% by weight, exhibited as high spheroidization ratios as 45-95% with smaller weight loss by oxidation of 22 mg/cm$^2$ or less. Examples 40, 41, 46-48, 53-55 and 60 exhibited as low spheroidization ratios as 31-58% with relatively large weight loss by oxidation of 28 mg/cm$^2$ or less, because the S contents were less than 0.003% by weight or more than 0.02% by weight though the rare earth elements were 0.05% or less by weight. Accordingly, even in the composition range of the present invention, it is preferable that the rare earth elements are 0.05% or less by weight, and that S is 0.003-0.02% by weight.

(b) Oxidation Resistance Test by Heating and Cooling

The oxidation resistance of each test piece was evaluated under the conditions of repeatedly heating and cooling it between 700° C. and 850° C. 100 times at temperature-elevating and lowering speeds of 3° C./minute. The results are shown in Table 5. The weight loss by oxidation under the heating/cooling condition was 98 mg/cm$^2$ or less in the test pieces of Examples 1-74. As is clear from Table 5, in Examples 1-14, in which the amounts of other components than W were substantially the same, the weight loss by oxidation tended to decrease as the W content increased from 1.26% by weight to 14.7% by weight. The test pieces of Comparative Examples 1, 2, 14 and 15 suffered weight loss of 101-172 mg/cm$^2$ by oxidation, more than that in Examples 1-74. Comparative Examples 3-13 and 16 suffered weight loss of 91 mg/cm$^2$ or less by oxidation, with poorer thermal cracking lives described below than those of Examples 1-74. Conventional Examples 1, 2, 4 and 5 suffered weight loss of 150-289 mg/cm$^2$ by oxidation, extremely larger than that in Examples 1-74, meaning that Conventional Examples 1, 2, 4 and 5 were extremely poor in oxidation resistance. Conventional Examples 3 and 6 suffered weight loss by oxidation of 97 mg/cm$^2$ and 88 mg/cm$^2$, respectively, with poorer thermal cracking lives described below than those of Examples 1-74.

The comparison of Examples 1 and 16-18 having substantially the same Si and W contents and different Ni contents revealed that when the Ni content was up to 0.48%, the weight loss by oxidation changed slightly in a range of 77-79 mg/cm$^2$, but the weight loss by oxidation increased drastically to 98 mg/cm$^2$ in Example 18 in which Ni exceeded 0.5% by weight. Accordingly, Ni is preferably less than 0.5% by weight.

Figure 13A:
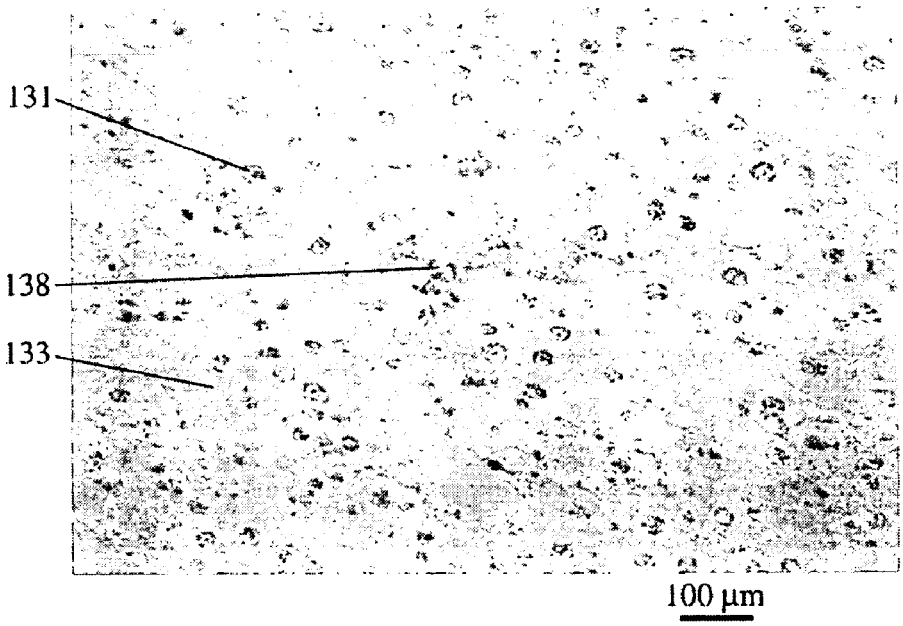
FIG. 13(*a*) is an FE-SEM photograph showing the surface oxidation of the heat-resistant cast iron of Example 8 in an initial stage.
Figure 13B:
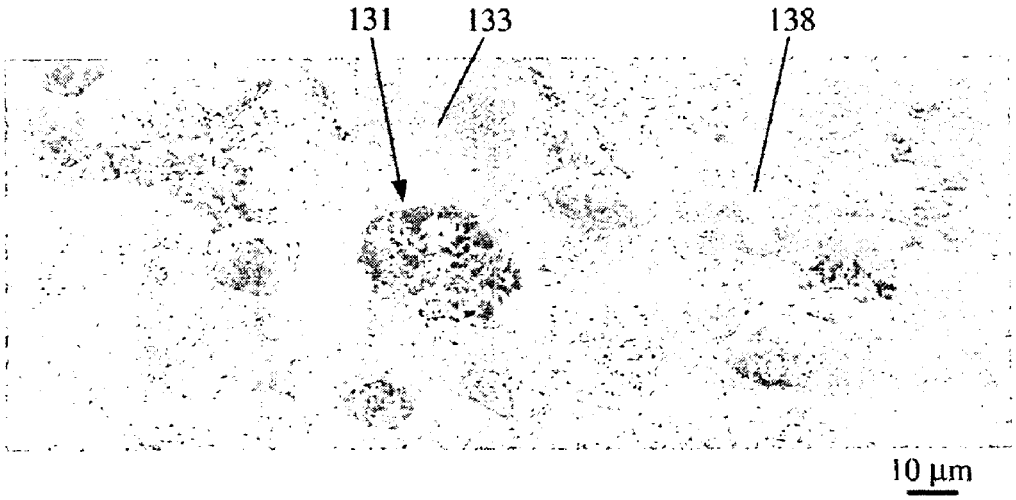
Figure 14A:
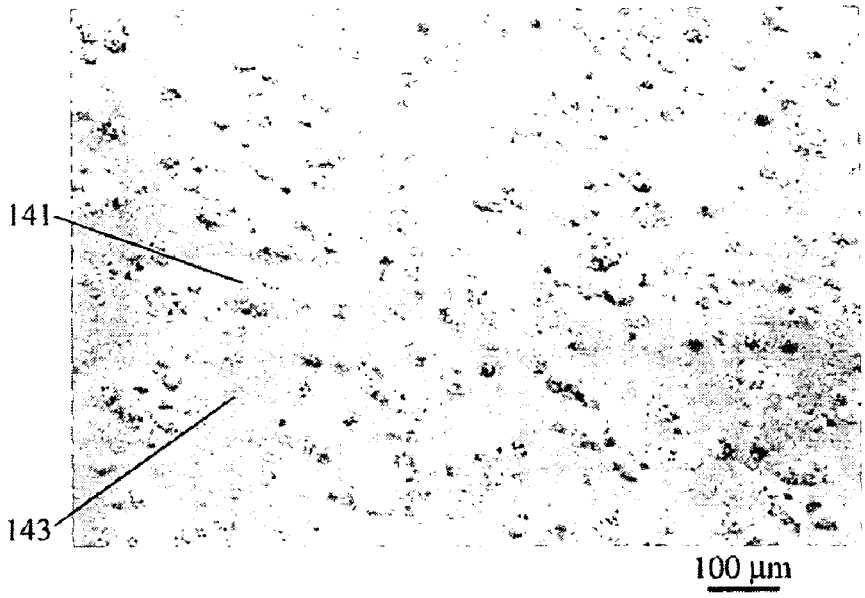
FIG. 14(*a*) is an FE-SEM photograph showing the surface oxidation of the heat-resistant cast iron of Conventional Example 3 in an initial stage.
Figure 14B:
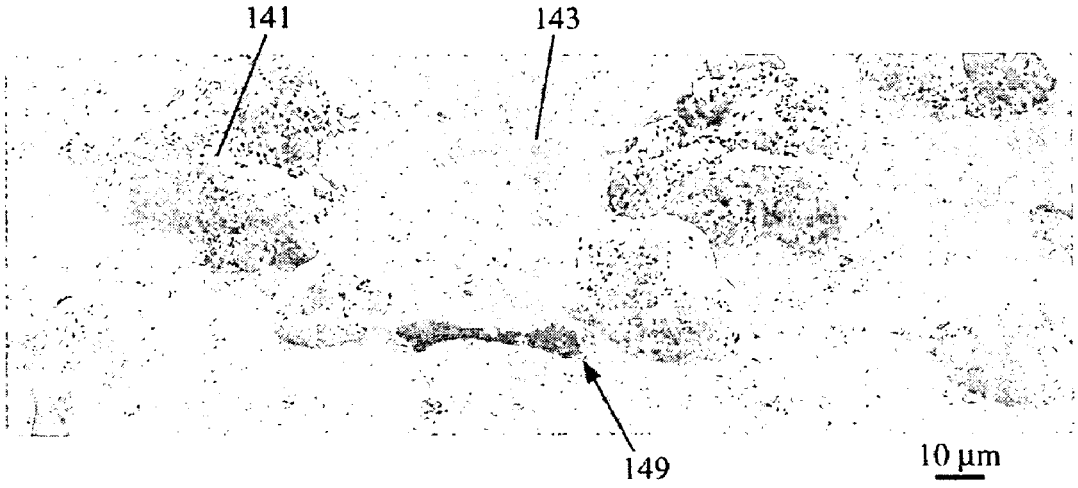

To investigate the initial oxidation behavior of the heat-resistant cast iron of the present invention, namely where it was predominantly oxidized, a heat-resistant cast iron sample was mirror-polished with diamond grinder powder, washed with an organic solvent, heated from room temperature to 1000° C. at 10° C./minute in the air, kept at 1000° C. for 10 minutes, cooled at 10° C./minute, and then subjected to FE-SEM observation of oxides formed on the surface. FIGS. 13 and 14 are FE-SEM photographs of Example 8 and Conventional Example 3, respectively.

It is clear from FIG. 13 that oxidation was suppressed in the sample of Example 8 in portions having graphite particles 131 before the test and their surrounding matrix regions 133, with substantially no projecting oxides observed. Although eutectic cell boundaries 138 were predominantly oxidized, their extent was small. Recesses by decarburization were observed in the graphite particles 131, presumably because the graphite particles 131 exposed to the surface by grinding were burned out. What should be noted is that portions having graphite particles 131 before the test became voids or had burning residue with substantially no projecting oxides, meaning that oxidation did not proceed from portions having the graphite particles 131 to the surrounding matrix regions. It is thus considered that even if external oxidizing gases intrude into graphite, their further intrusion is hindered in Example 8 because of the intermediate layers, in which W and Si were concentrated, and the W-containing carbide particles existing in and substantially in graphite-matrix boundaries, so that the oxidation of the matrix around the graphite particles is suppressed. On the contrary, as is clear from FIG. 14, portions 141 having graphite particles before the test were predominantly oxidized to form large oxides in the sample of Conventional Example 3, though it was a high-Si containing material Cr and Mo.

It is thus clear that the heat-resistant cast iron of Example 8 and that of Conventional Example 3 are totally different in initial oxidation behavior. In the heat-resistant cast iron of Example 8, the progress of oxidation starting from the graphite particles was suppressed, resulting in drastically improved oxidation resistance and thermal crack resistance.

TABLE 5

| | Weight Loss By Oxidation ($mg/cm^2$) | | | | |
|---|---|---|---|---|---|
| | At 800° C. for 200 hrs | Repeated Heating & Cooling from 700° C. to 850° C. | $A_{C1}$ (° C.) | Thermal Cracking Life (Cycles) | Room-Temp. Elongation (%) |
| No. | | | | | |
| Example 1 | 72 | 77 | 815 | 810 | 16.3 |
| Example 2 | 66 | 69 | 817 | 822 | 16.0 |
| Example 3 | 64 | 65 | 820 | 831 | 15.7 |
| Example 4 | 58 | 62 | 842 | 824 | 16.9 |
| Example 5 | 52 | 54 | 845 | 835 | 15.5 |
| Example 6 | 45 | 50 | 840 | 835 | 13.5 |
| Example 7 | 43 | 45 | 855 | 850 | 12.0 |
| Example 8 | 19 | 21 | 881 | 863 | 8.0 |
| Example 9 | 21 | 27 | 881 | 850 | 2.6 |
| Example 10 | 23 | 25 | 883 | 841 | 7.7 |
| Example 11 | 20 | 26 | 879 | 877 | 2.5 |
| Example 12 | 22 | 25 | 877 | 850 | 2.4 |
| Example 13 | 20 | 26 | 880 | 880 | 1.8 |
| Example 14 | 19 | 22 | 882 | 818 | 1.4 |
| Example 15 | 15 | 23 | 901 | 799 | 1.8 |
| Example 16 | 75 | 77 | 813 | 805 | 16.0 |
| Example 17 | 77 | 79 | 810 | 801 | 16.2 |
| Example 18 | 86 | 98 | 802 | 780 | 16.0 |
| Example 19 | 35 | 47 | 897 | 785 | 1.0 |
| Example 20 | 68 | 69 | 810 | 808 | 15.9 |
| Example 21 | 64 | 66 | 807 | 786 | 6.5 |
| Example 22 | 74 | 76 | 810 | 801 | 15.5 |
| Example 23 | 76 | 79 | 807 | 800 | 12.8 |
| Example 24 | 36 | 40 | 840 | 862 | 12.9 |
| Example 25 | 17 | 22 | 891 | 782 | 2.1 |
| Example 26 | 22 | 28 | 879 | 785 | 4.2 |
| Example 27 | 28 | 35 | 856 | 861 | 7.6 |
| Example 28 | 24 | 30 | 855 | 842 | 6.0 |
| Example 29 | 40 | 52 | 805 | 794 | 4.2 |
| Example 30 | 26 | 32 | 863 | 864 | 5.5 |
| Example 31 | 24 | 30 | 862 | 870 | 3.3 |
| Example 32 | 26 | 32 | 852 | 850 | 2.8 |
| Example 33 | 54 | 68 | 835 | 788 | 1.6 |
| Example 34 | 22 | 27 | 871 | 889 | 3.1 |
| Example 35 | 23 | 29 | 866 | 901 | 2.2 |
| Example 36 | 27 | 33 | 860 | 786 | 14.9 |
| Example 37 | 28 | 35 | 860 | 792 | 14.6 |
| Example 38 | 33 | 38 | 856 | 782 | 13.2 |
| Example 39 | 36 | 38 | 859 | 783 | 13.9 |
| No.(1) | | | | | |
| Comp. Ex. 1 | 101 | 172 | 769 | 700 | 18.9 |
| Comp. Ex. 2 | 85 | 136 | 825 | 720 | 14.1 |
| Comp. Ex. 3 | 45 | 49 | 866 | 740 | 11.2 |
| Comp. Ex. 4 | 40 | 45 | 869 | 745 | 10.0 |
| Comp. Ex. 5 | 82 | 91 | 833 | 736 | 12.1 |
| Comp. Ex. 6 | 32 | 43 | 930 | 748 | 5.9 |
| Comp. Ex. 7 | 25 | 44 | 871 | 755 | 8.7 |
| Comp. Ex. 8 | 24 | 42 | 870 | 771 | 9.4 |
| Comp. Ex. 9 | 28 | 44 | 870 | 769 | 5.0 |
| Comp. Ex. 10 | 26 | 42 | 860 | 775 | 8.8 |
| Comp. Ex. 11 | 33 | 35 | 879 | 718 | 0.8 |
| Comp. Ex. 12 | 65 | 88 | 843 | 724 | 0.9 |

TABLE 5-continued

| | Weight Loss By Oxidation ($mg/cm^2$) | | | | |
|---|---|---|---|---|---|
| | At 800° C. for 200 hrs | Repeated Heating & Cooling from 700° C. to 850° C. | $A_{C1}$ (° C.) | Thermal Cracking Life (Cycles) | Room-Temp. Elongation (%) |
| Comp. Ex. 13 | 28 | 35 | 927 | 711 | 0.7 |
| Comp. Ex. 14 | 92 | 110 | 796 | 742 | 19.5 |
| Comp. Ex. 15 | 89 | 101 | 805 | 708 | 2.8 |
| Comp. Ex. 16 | 27 | 34 | 933 | 737 | 1.2 |
| Con. Ex. 1 | 150 | 220 | 725 | 285 | 17.4 |
| Con. Ex. 2 | 91 | 150 | 804 | 421 | 18.2 |
| Con. Ex. 3 | 74 | 97 | 842 | 671 | 4.8 |
| Con. Ex. 4 | 117 | 155 | 856 | 669 | 7.0 |
| Con. Ex. 5 | 220 | 289 | — | 508 | 16.6 |
| Con. Ex. 6 | 65 | 88 | — | 588 | 11.5 |
| No. | | | | | |
| Example 40 | 20 | 24 | 886 | 815 | 5.0 |
| Example 41 | 19 | 22 | 877 | 830 | 6.0 |
| Example 42 | 18 | 21 | 888 | 862 | 7.0 |
| Example 43 | 16 | 19 | 877 | 906 | 9.4 |
| Example 44 | 15 | 17 | 876 | 921 | 10.6 |
| Example 45 | 17 | 20 | 884 | 899 | 10.0 |
| Example 46 | 22 | 27 | 885 | 820 | 4.9 |
| Example 47 | 26 | 32 | 876 | 813 | 3.7 |
| Example 48 | 19 | 23 | 876 | 825 | 4.0 |
| Example 49 | 18 | 21 | 884 | 847 | 5.0 |
| Example 50 | 17 | 20 | 885 | 872 | 7.6 |
| Example 51 | 16 | 19 | 887 | 881 | 8.6 |
| Example 52 | 17 | 21 | 870 | 868 | 7.6 |
| Example 53 | 22 | 28 | 874 | 814 | 4.3 |
| Example 54 | 28 | 35 | 887 | 808 | 3.3 |
| Example 55 | 24 | 29 | 877 | 814 | 3.7 |
| Example 56 | 22 | 26 | 889 | 831 | 4.2 |
| Example 57 | 18 | 22 | 881 | 842 | 6.0 |
| Example 58 | 18 | 21 | 886 | 859 | 6.2 |
| Example 59 | 19 | 23 | 874 | 840 | 4.6 |
| Example 60 | 26 | 33 | 878 | 813 | 3.5 |
| Example 61 | 63 | 78 | 872 | 799 | 2.8 |
| Example 62 | 51 | 63 | 877 | 804 | 3.0 |
| Example 63 | 46 | 56 | 878 | 805 | 3.5 |
| Example 64 | 40 | 48 | 884 | 804 | 3.6 |
| Example 65 | 38 | 46 | 884 | 808 | 3.4 |
| Example 66 | 42 | 52 | 875 | 804 | 3.5 |
| Example 67 | 71 | 90 | 891 | 798 | 3.0 |
| Example 68 | 22 | 26 | 881 | 880 | 2.8 |
| Example 69 | 23 | 26 | 879 | 885 | 3 |
| Example 70 | 35 | 42 | 878 | 800 | 1.4 |
| Example 71 | 25 | 29 | 879 | 810 | 1.8 |
| Example 72 | 26 | 30 | 874 | 814 | 1.8 |
| Example 73 | 36 | 45 | 877 | 801 | 1.3 |
| Example 74 | 52 | 65 | 881 | 785 | 0.7 |

Note:
(1)"Comp. Ex." represents Comparative Example, and "Con. Ex." represents Conventional Example.

(3) Thermal Crack Resistance

To evaluate the thermal crack resistance (thermal cracking life), each round-rod test piece of Examples 1-74, Comparative Examples 1-16 and Conventional Examples 1-6 having a gauge length of 20 mm and a diameter of 10 mm in the gauge length was set in an electric-hydraulic servo, thermal fatigue tester at a constraint ratio of 0.25, and subjected to thermal fatigue fracture by repeating a 7-minute heating/cooling cycle in the air. The heating/cooling cycle (lower limit temperature: 150° C., upper limit temperature: 840° C., and temperature amplitude: 690° C.) comprised heating from the lower limit temperature to the upper limit temperature over 2 minutes, keeping at the upper limit temperature for 1 minute, and cooling from the upper limit temperature to the lower limit temperature over 4 minutes. The constraint ratio was a percentage of mechanically constraining the elongation and shrinkage of a test piece caused by heating and cooling, which is determined by (elongation by free thermal expansion−elongation by thermal expansion under mechanical constraint)/(elongation by free thermal expansion). For instance, the constraint ratio of 1.0 means the mechanical constraint condition that a test piece is not elongated at all when heated. The constraint ratio of 0.5 means the mechanical constraint condition that for instance, when the elongation by free thermal expansion is 2 mm, the thermal expansion causes 1-mm elongation. Because the constraint ratios of exhaust equipment members for actual automobile engines are about 0.1-0.5, permitting elongation to some extent by heating and cooling, the constraint ratio was set at 0.25 in the thermal fatigue test.

The test results of thermal crack resistance (thermal cracking life) are shown in Table 5. The thermal cracking life was as long as 780-921 cycles in Examples 1-74, while it was as short as 285-671 cycles in Conventional Examples 1-6.

As is clear from Table 5, the thermal cracking life was as long as 780 cycles or more in the test pieces of Examples 1-74 having intermediate layers, in which W and Si were concentrated. Also, the thermal cracking life was 780 cycles in Example 18, in which the weight ratio (Xi/Xm) of the percentage Xi of W in the intermediate layers to the percentage Xm of W in the matrix was 4.72, while it was as long as 800 cycles or more in most other Examples, in which Xi/Xm was 5 or more. Further, the thermal cracking life was 785 cycles in Example 19, in which the weight ratio (Yi/Ym) of the percentage Yi of Si in the intermediate layers to the percentage Ym of Si in the matrix was 1.31, while it was mostly as long as 800 cycles or more in other Examples, in which Yi/Ym was 1.5 or more.

In Examples 2-19, 24-39 and 40-74, in which the number of graphite particles having W-containing carbide particles substantially in their boundaries with the matrix was 75% or more of the total number of graphite particles, the thermal cracking life was 780-880 cycles in Examples 2-19, 782-901 cycles in Examples 24-39, and as long as 785-921 cycles in Examples 40-74. In the test pieces of Examples 1-35 and 40-74, in which the number of W-containing carbide particles per a unit area of graphite was $3\times10^5/mm^2$ or more, the thermal cracking life was as long as 780-921 cycles. In the test pieces of Examples 1-14, 16, 18-21, 26-35 and 40-74, in which the area ratio of W-containing carbide on the graphite surface was 2% or more, the thermal cracking life was as long as 780-921 cycles.

The comparison of Examples 1 and 18 having substantially the same Si and W contents and different Ni contents revealed that the thermal cracking life of Example 18, in which the Ni content exceeded 0.5% by weight, was 780 cycles, shorter than the thermal cracking life (810 cycles) of Example 1 containing no Ni. The thermal cracking life of Example 16, in which the Ni content was 0.29% by weight, was 805 cycles, slightly poorer than that of Example 1 containing no Ni, but it was within a range causing no problems. Accordingly, Ni is preferably less than 0.5% by weight, more preferably 0.3% or less by weight.

The comparison of Examples 1 and 21 having substantially the same Si and W contents and different Cr contents revealed that the thermal cracking life of Example 21, in which the Cr content exceeded 0.3% by weight, was 786 cycles, shorter than that of Example 1 containing no Cr. The thermal cracking life of Example 20, in which the Cr content was 0.29% by weight, was 808 cycles, slightly poorer than that of Example 1 containing no Cr, but it was within a range causing no problems. Accordingly, Cr is preferably 0.3% or less by weight.

The comparison of the test pieces of Examples 1, 2 and 27 having substantially the same W contents within a range of 1.21-1.50% and Mo contents within a range of 0-4.4% by weight revealed that the thermal cracking life was improved from 810 cycles to 861 cycles as the Mo content increased. However, in Example 29, in which Mo was more than 5.5% by weight, the thermal cracking life was as short as 794 cycles. Thus, the Mo content is preferably 5.5% or less by weight, more preferably 4.5% or less by weight.

The comparison of Examples 30-32 having W contents within a range of 2.64-2.92% by weight and different Cu contents revealed that the addition of 0.13-6.1% by weight of Cu provided as long a thermal cracking life as 850-870 cycles. However, the test piece of Example 32 containing 6.1% by weight of Cu had a slightly shorter thermal cracking life than that of the test piece of Example 31 containing 3.5% by weight of Cu. Also, when the Cu content became 6.8% by weight as in Example 33, the thermal cracking life was reduced to 788 cycles. Accordingly, the Cu content was preferably 6.5% or less by weight, more preferably 3.5% or less by weight.

Examples 34 and 35 with W contents of 3.12-3.33% by weight exhibited thermal cracking lives of 889-901 cycles, better than the thermal cracking life of 863 cycles in Example 8 containing no Co. Accordingly, Co is preferably added, but it is preferably 5% or less by weight from the aspect of cost, because it is an expensive element.

(4) $A_{C1}$ Transformation Point

Figure 15:
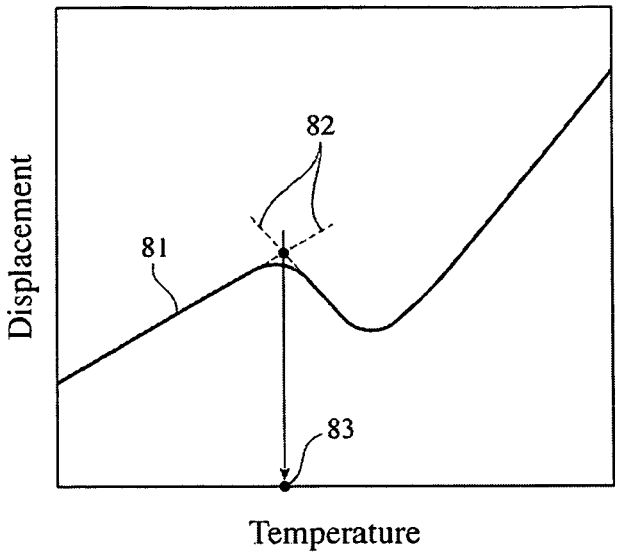
FIG. 15 is a view showing a method for reading the $A_{C1}$ transformation point.

Each cylindrical test piece (diameter: 5 mm, length: 20 mm) of Examples 1-74, Comparative Examples 1-16 and Conventional Examples 1-6 was heated from 30° C. at a speed of 3° C./minute in a nitrogen atmosphere to measure its $A_{C1}$ transformation point, by a thermomechanical analyzer ("TMA-4000S" available from Mac Science). As shown in FIG. 15, the $A_{C1}$ transformation point was determined by an intersection method comprising drawing tangents 82 in an inflecting region of a temperature-displacement curve 81, and reading a temperature at the intersection of the tangents as the $A_{C1}$ transformation point 83. The results are shown in Table 5. Incidentally, the austenitic spheroidal graphite cast iron of Conventional Examples 5 and 6 does not undergo $A_{C1}$ transformation unlike the ferritic spheroidal graphite cast iron.

Among the test pieces of Examples 1-74, those having as high $A_{C1}$ transformation points as 840° C. or higher had as long thermal cracking lives as 782 cycles or more. However, the test piece of Conventional Example 4 had low oxidation resistance and thermal crack resistance because graphite was predominantly oxidized due to as small W content as less than 0.001% by weight, although its $A_{C1}$ transformation point was higher than 840° C.

The comparison of Examples 1 and 18 having substantially the same Si and W contents and different Ni contents revealed that Example 18, in which the Ni content exceeded 0.5% by weight, had a lower $A_{C1}$ transformation point than that of Example 1 containing no Ni. In Example 16, in which the Ni content was 0.29% by weight, the $A_{C1}$ transformation point was 813° C., slightly lower than that of Example 1 containing no Ni, but it is within a range causing no problems. Accordingly, Ni is preferably less than 0.5% by weight, more preferably 0.3% or less by weight.

The comparison of Examples 1 and 21 having substantially the same Si and W contents and different Cr contents revealed that Example 21, in which the Cr content exceeded 0.3% by weight, had a lower $A_{C1}$ transformation point than that of Example 1 containing no Cr. In Example 20, in which the Cr content was 0.29% by weight, the $A_{C1}$ transformation point was 810° C., slightly lower than that of Example 1 containing no Cr, but it is within a range causing no problems. Accordingly, Cr is preferably 0.3% or less by weight.

(5) Room-temperature Elongation

Each No. 4 test piece (JIS Z 2201) of Examples 1-74, Comparative Examples 1-16 and Conventional Examples 1-6 was measured with respect to room-temperature elongation (%) at 25° C. by an Amsler tensile strength tester. The results are shown in Table 5.

The room-temperature elongation was as low as 0.8% in the test piece of Comparative Example 11 with 15.22% by weight of W, 1.0% in the test piece of Example 19 with 14.7% by weight of W, 1.8% in the test piece of Example 13 with 9.56% by weight of W, and 2.5% in the test piece of Example 11 with 4.83% by weight of W. Thus, when the W content is 10% or less by weight, particularly 5% or less by weight, the room-temperature elongation of 1.8% or more can be obtained. The room-temperature elongation is preferably 2% or more.

To investigate how elongation increases by the addition of Nb and B, attention was paid to the room-temperature elongation of Examples 36-39 containing Nb and/or B, the W contents being substantially the same within 1.21-1.66% by weight. The room-temperature elongation was 14.9% in the test piece of Example 36 containing only Nb, 14.6% and 13.9% in the test pieces of Examples 37 and 39 containing only B, and 13.2% in the test piece of Example 38 containing both Nb and B, all being good results.

The room-temperature elongation was 1.4% in Example 14, in which Si+(2/7)W was 8.76, 1.8% in Example 13, in which Si+(2/7)W was 7.38, 1.8% in Example 15, in which Si+(2/7)W was 6.03, and 2.5% in Example 11, in which Si+(2/7)W was 6.00. These results reveal that when Si+(2/7)W is 8 or less, the room-temperature elongation is 1.8% or more, and that when Si+(2/7)W is 6 or less, the room-temperature elongation is 2.0% or more.

The comparison of Examples 1 and 21 having substantially the same Si and W contents and different Cr contents revealed that Example 21, in which the Cr content exceeded 0.3% by weight, had smaller room-temperature elongation than that of Example 1 containing no Cr. The room-temperature elongation of Example 20, in which the Cr content was 0.29% by weight, was 15.9%, smaller than that of Example 1 containing no Cr, but it is within a range causing no problems. Accordingly, Cr is preferably 0.3% or less by weight.

The comparison of Examples 40-60 and Examples 61-67 having substantially the same Si and W contents and different rare earth element contents revealed that Examples 61-67, in which the rare earth elements exceeded 0.05% by weight, had as low spheroidization ratios as 20-28% and as small room-temperature elongation as 2.8-3.6% at any S content level. On the contrary, Examples 42-45, 49-52 and 56-59 containing rare earth elements of 0.05% or less by weight and 0.003-0.02% by weight of S had as high spheroidization ratios as 45-95% and as large room-temperature elongation as 4.2-10.6%. In Examples 40, 41, 46-48, 53-55 and 60, in which the S content was less than 0.003% by weight or more than 0.02% by weight, though the rare earth elements were 0.05% or less by weight, the spheroidization ratios were as low as 31-58%, and thus relatively low room-temperature elongation of 3.3-6.0%. Accordingly, even within the composition range of the present invention, the rare earth element is preferably 0.05% or less by weight, and S is preferably 0.003-0.02% by weight.

The test piece of Example 8 was subjected to a tensile test at 400° C. to examine its medium-temperature embrittlement. It was thus found that the elongation at 400° C. was 7.0%, slightly smaller than the room-temperature elongation of 8.0%, but it was at such a level not to practically cause any problems.

EXAMPLE 75

Figure 17:
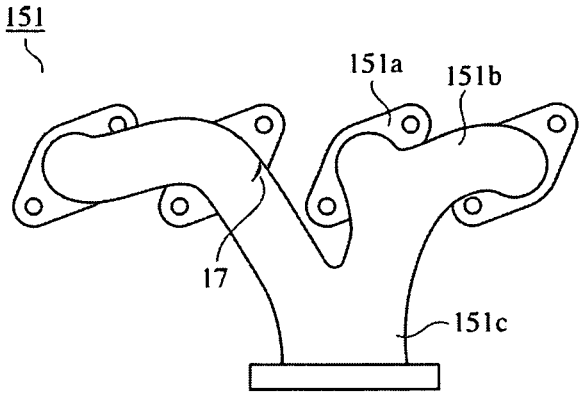
FIG. 17 is a schematic plan view showing the exhaust manifold of Example 75 after the durability test.

The exhaust manifold 151 schematically shown in FIG. 17 was formed from the heat-resistant cast iron of Example 9, and machined in an as-cast state. The resultant exhaust manifold 151 was free from casting defects such as shrinkage cavities, misrun, gas defects, etc., and did not suffer insufficient cutting, etc. at all when machined. In FIG. 17, 151*a* denotes flanges, 151*b* denotes branched tubes, and 151*c* denotes a convergence portion.

The exhaust manifold 151 of Example 75 was assembled to an exhaust simulator of a high-performance, 2000-cc, series-four-cylinder gasoline engine, to conduct a durability test to examine a life until cracking occurred and how the cracking occurred. The test condition was the repetition of a heating/cooling cycle comprising 10-minute heating and 10-minute cooling, to count the number of cycles until cracks penetrating the exhaust manifold 151 are generated. The exhaust gas temperature at a full load in the durability test was 920° C. at the exit of the exhaust manifold 151. The surface temperature of the exhaust manifold 151 under this condition was about 840° C. in the convergence portion 151*c*.

As shown in FIG. 17, extremely small cracks 17 were generated in regions of the branched tubes 151*b* adjacent to the flanges 151*a* by 890 cycles in the exhaust manifold 151 of Examples 75. However, no cracks were generated particularly in the convergence portion 151*c*, through which a high-temperature exhaust gas passed, and little oxidation took place in the overall manifold. This confirmed that the exhaust manifold 151 of Examples 75 had excellent durability and reliability.

EXAMPLE 76

An exhaust manifold 151 was formed by the heat-resistant cast iron of Example 8 in the same manner as in Example 75 except for conducting annealing for ferritization by keeping it at 900° C. for 3 hours and then cooling it in a furnace. The resultant exhaust manifold 151 was free from casting defects, troubles such as heat-treatment deformation, and troubles during machining, etc. The exhaust manifold 151 of Example 76 was assembled to the exhaust simulator to conduct a durability test under the same condition as in Example 75. The surface temperature of the exhaust manifold 151 was the same as in Example 75. The durability test revealed that extremely small cracks were generated in the exhaust manifold 151 of Example 76 by 952 cycles substantially to the same degree and in the same portions as in Example 75. However, no cracks were generated in the convergence portion, through which a high-temperature exhaust gas passed, with substantially no oxidation occurring in the entire manifold, indicating that it had excellent durability and reliability.

CONVENTIONAL EXAMPLE 7

Figure 18:
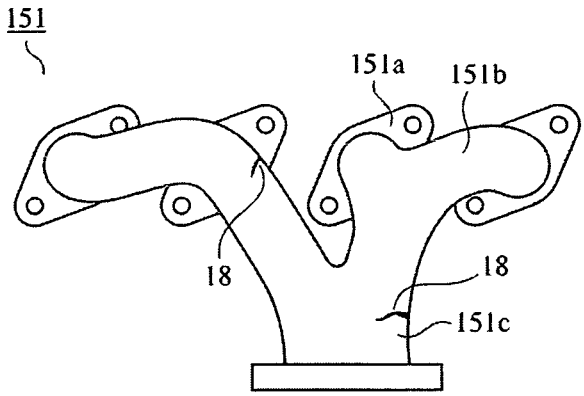
FIG. 18 is a schematic plan view showing the exhaust manifold of Conventional Example 7 after the durability test.

An exhaust manifold 151 was formed by the spheroidal graphite cast iron of Conventional Example 3 in the same manner as in Example 75 except for changing the heat treatment temperature to 940° C. This exhaust manifold 151 was assembled to the exhaust simulator to conduct the durability test under the same condition as in Example 75. The exhaust manifold 151 neither had casting defects nor suffered troubles in the heat treatment and machining. The surface temperature of the exhaust manifold 151 in the durability test was the same as in Example 75. As shown in FIG. 18, the durability test revealed that large cracks 18 were generated in the exhaust manifold 151 of Conventional Example 7 by 435 cycles in the convergence portion 151*c*, and between the branched tubes 151*b* and the flanges 151*a*. In addition to the convergence portion 151*c*, oxidation took place in the entire manifold.

CONVENTIONAL EXAMPLE 8

Figure 19:
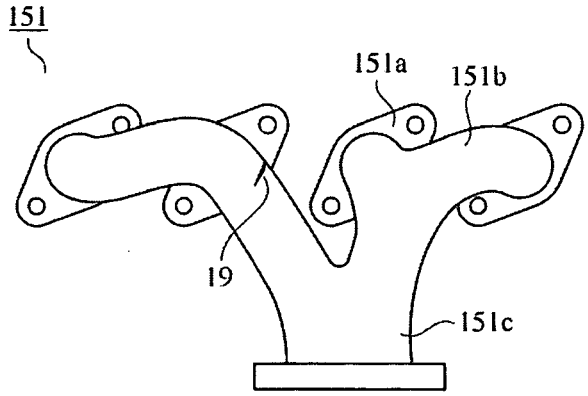
FIG. 19 is a schematic plan view showing the exhaust manifold of Conventional Example 8 after the durability test.

An exhaust manifold 151 was formed by the NI-RESIST D5S of Conventional Example 6 in the same manner as in Example 75 except for conducting a heat treatment comprising keeping at 910° C. for 4 hours and air-cooling. This exhaust manifold 151 was assembled to the exhaust simulator to conduct the durability test under the same condition as in Example 75. Neither casting defects nor troubles in the heat treatment and machining were observed in the exhaust manifold 151. The surface temperature of the exhaust manifold 151 in the durability test was the same as in Example 75. As shown in FIG. 19, the durability test revealed that large cracks 19 were generated in the exhaust manifold 151 of Conventional Example 8 by 558 cycles between the branched tubes 151*b* and the flanges 151*a*. Oxidation took place in the entire manifold, and the degree of oxidation was less than in Conventional Example 7, but the same as or slightly more than in Examples 75 and 76.

CONVENTIONAL EXAMPLES 9, 10

An exhaust manifold 151 was produced and subjected to the durability test in the same manner as in Example 75 except for using the same Hi-SiMo spheroidal graphite cast iron and heat treatment condition as in Conventional Example 2 (Conventional Example 9). Also, an exhaust manifold 151 was produced and subjected to the durability test in the same manner as in Example 75 except for using the same NI-RESIST D2 and heat treatment condition as in Conventional Example 5 (Conventional Example 10). Neither casting defects nor troubles in the heat treatment and machining were observed in any exhaust manifold 151. The surface temperature of the exhaust manifold 151 in the durability test was the same as in Example 75.

Table 6 shows lives until cracking occurred in the exhaust manifolds of Examples 75 and 76 and Conventional Examples 7-10. The exhaust manifolds of Examples 75 and 76 exhibited about 1.5 times to 5 times as long lives until cracking occurred as those of Conventional Examples 7-10.

TABLE 6

Durability Test Results of Exhaust Manifolds

| No.[1] | Type of Cast Iron | Life Until Cracking Occurred (Cycles) |
|---|---|---|
| Example 75 | Example 9 | 890 |
| Example 76 | Example 8 | 952 |
| Con. Ex. 7 | Conventional Example 3 (JP9-87796A) | 435 |
| Con. Ex. 8 | Conventional Example 6 (NI-RESIST D5S) | 558 |
| Con. Ex. 9 | Conventional Example 2 (Hi-SiMo) | 203 |
| Con. Ex. 10 | Conventional Example 5 (NI-RESIST D2) | 492 |

Note:
[1]"Con. Ex." represents "Conventional Example."

As described above, the exhaust manifolds formed by the heat-resistant cast iron of the present invention have excellent oxidation resistance and thermal crack resistance, with much longer lives than those of the conventional high-Si, ferritic spheroidal graphite cast iron, and also longer lives than those of the austenitic spheroidal graphite cast iron. Accordingly, the heat-resistant cast iron of the present invention can provide exhaust equipment members needing heat resistance for automobile engines at low costs as alternatives to high-quality materials such as conventional austenitic spheroidal graphite cast iron and cast stainless steel, etc.

Although explanation has been made above on exhaust equipment members for automobile engines, the heat-resistant cast iron of the present invention having excellent oxidation resistance and thermal crack resistance can be used, in addition thereto, for engine parts such as cylinder blocks, cylinder heads, pistons, piston rings, etc., furnace parts such as beds, carriers, etc. for incinerators and heat-treating furnaces, sliding members such as disc brake rotors, etc.

EFFECT OF THE INVENTION

As described above in detail, the heat-resistant cast iron of the present invention has better oxidation resistance and thermal crack resistance than those of conventional high-Si, ferritic spheroidal graphite cast iron, and well-balanced performance such as room-temperature elongation, high-temperature strength, high-temperature yield strength, etc., because of suppressed oxidation and decarburization of graphite and suppressed oxidation of the surrounding matrix regions. Accordingly, it is suitable for parts needing heat resistance, such as exhaust equipment members for automobile engines, etc.

What is claimed is:

1. A graphite-containing heat-resistant cast iron comprising Si and W, and having intermediate layers, in which W and Si are concentrated in the boundaries of graphite particles and a matrix, wherein said graphite-containing heat-resistant cast iron comprises 3.5-5.6% of Si and 1.2-15% of W on a weight basis, and wherein a ratio (Xi/Xm) of a weight ratio Xi of W in said intermediate layers to a weight ratio Xm of W in said matrix is 5 or more and a ratio (Yi/Ym) of a weight ratio Yi of Si in said intermediate layers to a weight ratio Ym of Si in said matrix is 1.5 or more, said heat-resistant cast iron having a composition consisting essentially of, on a weight basis, 1.5-4.5% of C, 3.5-5.6% of Si, 3% or less of Mn, 1.2-15% of W, and 1.0% or less of a graphite-spheroidizing element, the balance being substantially Fe and inevitable impurities, said graphite-spheroidizing element comprising 0.003-0.02% by weight of S and 0.05% or less by weight of a rare earth element in addition to 0.005-0.2% by weight of Mg as a graphite-spheroidizing element, said graphite-containing heat-resistant cast iron having a structure comprising a matrix based on a ferrite phase in an as-cast state and after heat treatment.

2. The heat-resistant cast iron according to claim 1, wherein the heat resistant cast iron meets $Si+(2/7)W \leqq 8$ on a weight basis.

3. The heat-resistant cast iron according to claim 1, further comprising 5.5% or less by weight of Mo.

4. The heat-resistant cast iron according to claim 1, further comprising 6.5% or less by weight of Cu.

5. The heat-resistant cast iron according to claim 1, further comprising 5% or less by weight of Co.

6. The heat-resistant cast iron according to claim 1, further comprising 1.0% or less by weight of Nb and/or 0.05% or less by weight of B.

7. The heat-resistant cast iron according to claim 1, wherein the number of graphite particles having W-containing carbide particles in the boundaries with said matrix is 75% or more of the total number of graphite particles.

8. The heat-resistant cast iron according to claim 1, wherein with respect to W-containing carbide particles on the surface of graphite particles exposed by etching, their number is $3\times10^5/mm^2$ or more, and/or their area ratio is 1.8% or more, per a unit area of graphite.

9. The heat-resistant cast iron according to claim 1, wherein au $A_{C1}$ transformation point of the heat resistant cast iron is 840° C. or higher when measured from 30° C. at a temperature-elevating speed of 3° C./minute.

10. The heat-resistant cast iron according to claim 1, wherein a weight loss by oxidation of the heat resistant cast iron is 60 $mg/cm^2$ or less when kept at 800° C. for 200 hours in the air.

11. The heat-resistant cast iron according to claim 1, wherein a thermal cracking life of the heat resistant cast iron is 780 cycles or more in a thermal fatigue test, in which heating and cooling are conducted under the conditions of an upper-limit temperature of 840° C., a temperature amplitude of 690° C. and a constraint ratio of 0.25.

12. An exhaust equipment member made of the heat-resistant cast iron recited in claim 1.

13. The exhaust equipment member according to claim 12, wherein the exhaust equipment member is an exhaust manifold, a turbocharger housing, an exhaust manifold integral with a turbocharger housing, a catalyst case, an exhaust manifold integral with a catalyst case, or an exhaust outlet.

14. The exhaust equipment member used at temperatures exceeding 800° C., which is formed by a graphite-containing heat-resistant cast iron of claim 1, wherein Si and W meet the condition of $Si+(2/7)W \leqq 8$ on a weight basis, said heat-resistant cast iron having a structure comprising a matrix based on a ferrite phase in an as-cast state, in which graphite is crystallized, and intermediate layers, in which W and Si are concentrated in the boundaries of said graphite particles and said matrix, whereby the exhaust equipment member has an $A_{C1}$ transformation point of 840° C. or higher when measured from 30° C. at a temperature-elevating speed of 3° C./minute, and a thermal cracking life of 780 cycles or more in a thermal fatigue test, in which heating and cooling are conducted under conditions of an upper-limit temperature of 840° C., a temperature amplitude of 690° C. and a constraint ratio of 0.25.

15. The exhaust equipment member according to claim 14, wherein said Xi/Xm is 10 or more.

16. The exhaust equipment member according to claim 14, wherein said Yi/Ym is 2.0 or more.

17. The exhaust equipment member according to claim 14, wherein a weight loss by oxidation of the exhaust equipment member is 60 $mg/cm^2$ or less when kept at 800° C. for 200 hours in the air.

18. The exhaust equipment member according to claim 14, wherein said heat-resistant cast iron has a composition consisting essentially of, on a weight basis, 1.8-4.2% of C, 3.8-5.3% of Si, 1.5% or less of Mn, 1.5-10% of W, and 0.01-0.2% of a graphite-spheroidizing element, $Si+(2/7)W \leqq 8$, and the balance being substantially Fe and inevitable impurities.

* * * * *